US007124841B2

(12) United States Patent
Wada et al.

(10) Patent No.: US 7,124,841 B2
(45) Date of Patent: Oct. 24, 2006

(54) CRUSTAL CORE SAMPLER AND METHOD OF CORING CRUSTAL CORE SAMPLE USING THE SAME

(75) Inventors: Kazuyasu Wada, Kanagawa (JP); Yusuke Yano, Kanagawa (JP); Tomoya Inoue, Kanagawa (JP); Masanori Kyo, Kanagawa (JP); Masaki Kawahara, Tokyo (JP)

(73) Assignees: Independent Administrative Institution Japan Agency for Marine-Earth Science & Technology, Yokosuka (JP); NLC Co., Ltd., Tokyo (JP)

( * ) Notice: Subject to any disclaimer, the term of this patent is extended or adjusted under 35 U.S.C. 154(b) by 165 days.

(21) Appl. No.: 10/837,294

(22) Filed: Apr. 30, 2004

(65) Prior Publication Data

US 2004/0256151 A1 Dec. 23, 2004

(30) Foreign Application Priority Data

Jun. 19, 2003 (JP) ..... 2003-174169

(51) Int. Cl.
*E21B 25/08* (2006.01)

(52) U.S. Cl. ..... 175/226; 175/58

(58) Field of Classification Search ..... 175/20, 175/58, 226, 233

See application file for complete search history.

(56) References Cited

U.S. PATENT DOCUMENTS 2,862,691 A * 12/1958 Cochran ..... 175/226
2,880,969 A * 4/1959 Williams ..... 175/226
3,064,742 A * 11/1962 Bridwell ..... 175/226
4,716,974 A * 1/1988 Radford et al. ..... 175/59
5,482,123 A 1/1996 Collee
6,719,070 B1 * 4/2004 Puymbroeck et al. ..... 175/59
2001/0000393 A1 * 4/2001 Collee et al. ..... 175/58
2002/0139583 A1 * 10/2002 Masui et al. ..... 175/58

FOREIGN PATENT DOCUMENTS

JP 2002-228558 A 8/2002

* cited by examiner

*Primary Examiner*—David Bagnell
*Assistant Examiner*—Daniel P Stephenson
(74) *Attorney, Agent, or Firm*—Frishauf, Holtz, Goodman & Chick, P.C.

(57) ABSTRACT

Disclosed herein are a crustal core sampler, by which a crustal core sample can be cored in a state coated with a flow-able coating material free of any contamination, and a method of coring a core sample using this crustal core sampler. The crustal core sampler comprises a drilling mechanism and a barrel, wherein the barrel is equipped with a flow-able coating material-ejecting mechanism, and a columnar crustal core portion is coated with a flow-able coating material. Alternatively, the crustal core sampler is constructed by a drill pipe and an inner barrel, wherein the inner barrel is equipped with an inner barrel body, a core elevator, a channel-forming member for forming a flow-able coating material-running channel and flow-able coating material-ejecting openings, and a columnar crustal core portion is coated with a flow-able coating material.

13 Claims, 14 Drawing Sheets

CRUSTAL CORE SAMPLER AND METHOD OF CORING CRUSTAL CORE SAMPLE USING THE SAME

BACKGROUND OF THE INVENTION

1. Field of the Invention

The present invention relates to a crustal core sampler for coring crustal core samples used for various researches, for example, biological researches on subsurface microorganisms or the like in a crustal core, and chemical, physical and geological researches, and a method of coring a crustal core sample using this crustal core sampler.

2. Description of the Background Art

In recent years, researches on crustal interiors have been advanced, and the presence of subterranean microorganisms under a deep-depth, high-temperature and high-pressure environment in a crustal interior has been reported. According to researches on subsurface microorganisms in a subterranean microbial sphere composed of these subterranean microorganisms, there is a possibility that important findings, for example, elucidation of influences by material conversion and mass transfer in a deep geological environment, elucidation of origin of life in the primitive earth and evolution thereof, or development of drugs and novel materials may be obtained. Further, chemical researches, physical researches or geological researches in such a deep-depth crustal interior are advanced from various points of view.

A crustal core sample used for such various researches as described above can be taken with comparative ease from the crust at the depth closer to mantle by drilling a submarine crust by means of, for example, a drill ship.

As an example of a method for conducting the drilling using the drill ship, for example, a riser drilling method has been generally known. In this method, a drill pipe extending from the drill ship to the sea bottom is rotated to drill the crust by means of a drill bit provided on the tip thereof and at the same time, a fluid (hereinafter also referred to as "working fluid") for drilling work, such as so-called drilling mud or sea water, the specific gravity, viscosity, chemical composition, etc. of which have been adjusted according to the condition of the crust drilled, is fed to the drill bit to remove drill debris, and to protect and stablize a side wall of the drill hole. Since the working fluid is fed through a circulating channel in the riser drilling method, the fluid is also referred to as "circulating fluid".

A crustal core sample taken by such a method has a great possibility that the state of the sample present in the crust as it is may be lost by an influence exerted from the outside during the coring operation, for example, by contact of the working fluid containing drill debris. In such a case, there is a possibility that the crustal core sample cored may become a sample lost its important information for intended researches.

In order to overcome with such a problem, there is disclosed a method of coring a crustal core sample, that an outer surface of the crustal core sample is coated with a flow-able coating material composed of gel or the like when the crustal core sample is taken, thereby obtaing the crustal core sample in a state that its mechanical structure or tissue has been protected from the outside (see, for example, U.S. Pat. No. 5,482,123).

It is also known to use an antimicrobial substance as a flow-able coating material, thereby taking a crustal core sample in a state protected from contamination with, for example, adventitious nonindigeneous microorganisms (see, Japanese Patent Application Laid-Open No. 2002-228558).

FIG. 1 illustrates a case where a sea bed crust is drilled by means of a drill ship in accordance with the riser drilling method.

In this drilling method, a drilling operation is conducted by a riser drilling system provided on a drill ship 10 on the surface 13 of the sea. In the riser drilling system, a riser pipe 20 extending downward from the drill ship 10 into the sea to connect the drill ship 10 to a sea floor 15 is provided, and a drill pipe 21 is arranged within this riser pipe 20. This drill pipe 21 is so constructed that its upper end is connected to a power swivel 11 that is a rotating drive mechanism on the drill ship 10, and its lower part enters the crust 16 through a blowout-preventing device 14. A drill bit 30 is provided at the lower end of the drill pipe 21.

The drill ship 10 is generally equipped with an automatic ship position keeping system constructed by correlating a plurality of thrusters 12*a*, 12*b* and 12*c* provided on the bottom of the ship, a differential global positioning system (DGPS) making good use of, for example, an artificial satellite, and the like. According to this automatic ship position keeping system, the position of the ship can be held within a region of a small radius centering an intended drill hole in the sea floor 15 without being affected by the wind, the tidal current and the like even in the open sea.

The drill bit 30 is so constructed that a plurality of semispherical cutter parts each protruding downward are formed at a lower end of an outer barrel 23 (see FIG. 11) so as to stand in its peripheral direction, and a plurality of cutter elements 31 (see FIG. 11) are fixed to each of the cutter parts.

The drill bit 30 is rotated through the drill pipe 21 by the power swivel 11, whereby the crust 16 is drilled from the sea floor 15, and the lower end of the drill pipe 21 goes down in the crust 16. At this time, a working fluid composed of drilling mud, seawater or the like is fed to the drill bit 30 through the drill pipe 21 within the riser pipe 20. A plurality of casing pipes 17 different in length from each other provided at the lower part of the blowout-preventing device 14 are inserted according to the depth of the drilling, whereby collapse of the wall surface in the drill hole is prevented.

A number of safety valves for pressure relief are provided in the blowout-preventing device 14, and the pressure within the drill hole is controlled by these safety valves, whereby rapid blowout of high-pressure hydrocarbon gases, interstitial water within the crust and/or the like is controlled to surely continue a safe drilling process.

FIG. 2 is a partial sectional view illustrating details of compositional units making up a riser pipe together with a section of a main pipe, taken along its axis, in a state that a drill pipe has been inserted therein.

As illustrated in FIG. 2, the riser pipe 20 is constructed by the main pipe 22 and a kill & choke line 27 provided independently of the main pipe 22, and a double-pipe structure is formed by the main pipe 22 and the drill pipe 21 arranged in the main pipe 22. A working fluid-running channel 24, through which the working fluid is fed, is formed by an internal space of the drill pipe 21. Through this internal space, various devices, for example, a mechanism forming a crustal core sampler, and the like, are guided to the drill hole. On the other hand, a circulating channel, through which the working fluid is returned back to the drill ship 10, is defined by an annular channel 25 formed between an inner peripheral wall surface of the main pipe 22 and an outer peripheral surface of the drill pipe 21.

More specifically, the working fluid is fed to the drill bit 30, ejected within the drill hole from working fluid-ejecting openings provided at lower end of the drill bit 30 and then circulated through the annular channel 25. This working fluid is a fluid the specific gravity, viscosity, chemical composition and the like of which have been adjusted according to, for example, the geology of the crust. For example, that obtained by mixing various modifiers into muddy water available in a drilling site may be used.

Incidentally, the necessary lengths of the main pipe 22 and the drill pipe 21, and increases thereof are actually achieved by successively joining a great number of respective elements thereof to one another as needed. In FIG. 2, reference numeral 28 indicates a line holder.

The above-described riser drilling method has such merits as described below, whereby a drilling work can be stably conducted.

(1) Removal of drill debris:

Drill debris collected on the bottom of the drill hole is conveyed to the drill ship 10 through the annular channel 25 by the working fluid ejected from the drill bit 30.

(2) Protection and stabilization of wall surface of drill hole:

The viscous component in the working fluid ejected from the drill bit 30 adheres to the wall surface of the drill hole to form a thin protective film 18, whereby collapse of the wall surface in the drill hole is prevented.

The specific gravity in the composition of the working fluid is adjusted, whereby the equilibration of pressure against the formation pressure in a deep depth can be conducted, and an effect of preventing a fluid in the formation from penetrating into the drill hole is brought about.

(3) Cooling and lubrication of drill bit:

The drill bit 30 is cooled by contact of the working fluid with its surface to prevent it from being excessively heated by gradually rising crustal heat, and lubricating action is achieved between the drill bit 30 and the crust, so that the degree of friction in the drill bit 30 is lowered to lessen the abrasion of the drill bit 30.

(4) The constitutive substances and the like of the drill debris contained in the working fluid sent on to the drill ship 10 are successively analyzed and monitored, whereby the geological condition of the crust, to which drilling is being conducted at this very moment, is easy to be always confirmed and grasped.

As understood from the above fact, the drill pipe 21 and drill bit 30 for drilling the crust 16 are required to permit feeding and ejecting the working fluid from the tip parts thereof, and the so-called coring bit having an opening at a central part along a rotating axis thereof is preferably used.

A case where a crustal core sample is cored by the riser drilling method using a conventional crustal core sampler disclosed in U.S. Pat. No. 5,482,123 is then specifically described.

FIGS. 11 and 12 are sectional views illustrating the states, in terms of sections, of a drill pipe and a drill bit in a drilling work. FIG. 11 illustrates a state right after drilling is started, while FIG. 12 illustrates a state that the drilling has been advanced.

In the crustal core sampler in this example, a pipe-like inner barrel 60 is arranged, in a mode that a thrust bearing (not illustrated) is intervened, in an outer barrel 23 making up a drill pipe 21 and provided with a drill bit 30 at the tip thereof.

At a lower end of the inner barrel 60, a disk-like flow-able coating material-ejecting opening member 62 is arranged in a state that liquid-tightness is retained so as to close the opening of the inner barrel through a ring-like sealing member 61, and relatively movably in a vertical direction within the inner barrel 60.

In this flow-able coating material-ejecting opening member 62, is formed flow-able coating material-ejecting holes 68 linking the interior of the inner barrel 60 with the outside and extending through in a vertical direction and is provided an opening and closing valve 65 for opening and closing the flow-able coating material-ejecting holes 68. In other words, the opening and closing valve 65 is constructed by a valve body member 64 vertically movably arranged on the inner side (upper surface side) of the flow-able coating material-ejecting opening member 62, a connecting rod 63 extending slidably in a vertical direction through the flow-able coating material-ejecting opening member 62 and a working disk 66 provided at a lower end of the connecting rod 63 and located on the outer side (lower surface side) of the flow-able coating material-ejecting opening member 62. The connecting rod 63 has a length longer than the thickness in the vertical direction of the flow-able coating material-ejecting opening member 62. A flow-able coating material 67 is filled in the interior of the inner barrel 60.

In the riser drilling method using the crustal core sampler having the structure described above, as illustrated in FIG. 11, the outer barrel 23 in a state rotated about an axis of the barrel, and the inner barrel 60 retained in a standstill state in this rotational direction by the thrust bearing go down from the sea floor 15 when drilling of the crust 16 is started, whereby the working disk 66 provided at the lower end in the connecting rod 63 is pushed up relatively upward by the sea floor 15, and the valve body member 64 is separated from the inner surface (upper surface) of the flow-able coating material-ejecting opening member 62 through the connecting rod 63 to open the flow-able coating material-ejecting holes 68. As a result, a state that the interior of the inner barrel 60 is linked with the outside is created, and the flow-able coating material 67 in the inner barrel 60 is ejected to the outside through the flow-able coating material-ejecting holes 68.

As illustrated in FIG. 12, a columnar crustal core portion P formed by drilling the periphery thereof with the downward movement of the outer barrel 23 and inner barrel 60 by the progress of the drilling, enters the interior of the inner barrel 60 from the central opening of the drill bit 30 while forming a narrow annular gap G between the outer peripheral surface of the columnar crustal core portion P and the inner peripheral wall surface of the inner barrel 60, and moreover the flow-able coating material-ejecting opening member 62 is moved relatively upward together with the columnar crustal core portion P gradually grown within the inner barrel 60 while retaining the state that the flow-able coating material-ejecting holes 68 has been linked with the interior.

As a result, the flow-able coating material 67 is ejected into the annular gap G through the flow-able coating material-ejecting holes 68 and adheres to the outer peripheral surface of the columnar crustal core portion P gradually grown.

The columnar crustal core portion P entered into the inner barrel 60 is broken at a lower portion thereof and taken. This crustal core portion is recovered as a crustal core sample with the inner barrel 60 on the drill ship 10 through the interior of the drill pipe 21 by a wire or the like.

When the coring of the crustal core sample is carried out by using such a crustal core sampler as described above, however, the following problems arise.

More specifically, the columnar crustal core portion P is passed through the interior of the inner barrel 60 while the outer peripheral surface thereof is coming into contact with the flow-able coating material 67 in the annular gap G, whereby impurities such as the working fluid adhered to the outer peripheral surface of the columnar crustal core portion P are mixed into the flow-able coating material 67.

In particular, the flow-able coating material 67 present at a position closer to the lower end of the annular gap G comes into contact with the outer peripheral surface of the columnar crustal core portion P over a longer distance, so that various impurities are mixed into the flow-able coating material 67 at the portion in a greater extent. As a result, the expected object cannot be sufficiently achieved.

Further, when the flow-able coating material 67 has a relatively high viscosity, or the columnar crustal core portion P formed is composed of a soft material, crustal substances derived from the crust of a specific depth migrate in an axial direction relatively to the columnar crustal core portion P through the flow-able coating material 67 in the annular gap G. As a result, a problem that such substances become impurities to substances at the position after the migration, and so the resultant crustal core sample becomes unsuitable for the expected researches arises.

In addition, in the construction of the crustal core sampler described above, it is actually impossible to coat the upper surface of the columnar crustal core portion P with the flow-able coating material 67. Accordingly, a problem that the crustal core sample cannot be obtained as a form completely coated with the flow-able coating material arises.

SUMMARY OF THE INVENTION

The present invention has been made on the basis of the foregoing circumstances and has as its object the provision of a crustal core sampler, by which a crustal core sample can be cored in a state coated with a flow-able coating material free of any contamination.

Another object of the present invention is to provide a method of coring a core sample using this crustal core sampler.

According to the present invention, there is thus provided a crustal core sampler for coring a crustal core sample by drilling the crust, which comprises a drilling mechanism for drilling the crust so as to form an annular drilled groove, and a cylindrical barrel, which has an opening for inserting a columnar crustal core portion at its lower end and receives a columnar crustal core portion provided as a crustal core sample in the interior thereof, wherein the barrel is equipped with a flow-able coating material-ejecting mechanism for ejecting a flow-able coating material inwardly in a radial direction of the barrel at a position in close vicinity of its lower end, and wherein the columnar crustal core portion formed by the drilling is coated with the flow-able coating material ejected from the flow-able coating material-ejecting mechanism in the course of being positioned in the interior of the barrel while being relatively raised in the barrel.

According to the present invention, there is also provided a crustal core sampler for coring a crustal core sample by drilling the crust using a fluid for drilling work, which comprises a cylindrical drill pipe equipped at its lower end with a drill bit having an ejection opening of the fluid for drilling work, and an inner barrel arranged in the drill pipe, wherein the inner barrel is equipped with a cylindrical inner barrel body, which has an opening for inserting a columnar crustal core portion at its lower end and receives a columnar crustal core portion formed by drilling and provided as a crustal core sample in the interior thereof, a core elevator arranged in an internal space of the inner barrel body and movably in an axial direction thereof, and a flow-able coating material-ejecting mechanism having a channel-forming member for forming a flow-able coating material-running channel with an outer peripheral surface of the inner barrel body and flow-able coating material-ejecting openings for ejecting a flow-able coating material from the flow-able coating material-running channel inwardly in a radial direction of the inner barrel body at a position in close vicinity of the lower end of the inner barrel body, and the inner barrel is arranged in such a manner that the opening for inserting the columnar crustal core portion is positioned above the ejection opening of the fluid for drilling work in the drill pipe, and wherein the columnar crustal core portion formed by the drilling is coated with the flow-able coating material ejected from the flow-able coating material-ejecting openings in the course of being positioned in the interior of the inner barrel body while being relatively raised in the internal space of the inner barrel body.

In the crustal core sampler described above, it may be preferable that a flow-able coating material reservoir for holding the flow-able coating material be defined by a space partitioned above the core elevator to be lifted, a crustal core sample-receiving space for receiving the crustal core sample be defined by a space partitioned below the core elevator, and the flow-able coating material reservoir be linked with the crustal core sample-receiving space by the flow-able coating material-running channel.

In the crustal core sampler, the running channel-forming member may preferably be a cylindrical member, by which a cylindrical flow-able coating material-running channel is formed with the outer peripheral surface of the inner barrel body.

It may also be preferable that the core elevator be composed of a core elevator body having a central through-hole, an opening and closing valve body for controlling a linked state between a space in the central through-hole and the flow-able coating material-ejecting openings by moving in a vertical direction be arranged in the central through-hole in the core elevator body, and a temporary linked state be achieved between the space in the central through-hole of the core elevator body and the flow-able coating material-ejecting openings at the beginning of upward movement of the core elevator body within the inner barrel body.

It may further be preferable that the opening and closing valve body be equipped with a columnar valve body part and a tubular rod part extending so as to protrude downward form the core elevator body through the central through-hole thereof and having an opening at its lower end, and a temporary linked state be achieved between the flow-able coating material-ejecting openings and the opening at the lower end of the rod part through the space within the central through-hole in the core elevator body at the beginning of upward movement of the core elevator body within the inner barrel body.

A working disk having a diameter greater than the outer diameter of the rod part may be arranged at a lower end of the rod part, and a contact member protruding downward from a bottom surface of the working disk may also be provided on the bottom surface of the working disk.

According to the present invention, there is further provided a method of coring a crustal core sample, which comprises using any one of the crustal core samplers described above, thereby coring the crustal core sample in a state coated with a flow-able coating material.

According to the crustal core sampler of the present invention, the flow-able coating material-ejecting openings are stationarily provided at the position in close vicinity of the lower end of the inner barrel, whereby the flow-able coating material is ejected toward the interior of the inner barrel to adhere to a passing surface of a columnar crustal core portion formed by the drilling. In addition, the flow-able coating material adhered to the surface of the columnar crustal core portion does basically not migrate from the adhered position at the surface of the columnar crustal core portion, so that the surface of the columnar crustal core portion is prevented from being contaminated with the flow-able coating material or the like. As a result, a crustal core sample can be obtained in a state that an outer surface thereof has been coated with a flow-able coating material free of any contamination.

In the crustal core sampler according to the present invention, the ejection speed of the flow-able coating material ejected from the ejecting openings is accelerated, whereby contaminants adhered to the outer peripheral surface of the columnar crustal core portion can also be washed off.

Further, the crustal core sampler of the present invention is so constructed that the rod part making up the opening and closing valve body is cylindrical, and the flow-able coating material is fed to the opening provided at the lower end of the rod part through the guiding channel for the flow-able coating material formed by the internal space of the rod part, whereby the flow-able coating material is fed to even the upper surface of the columnar crustal core portion. Accordingly, the columnar crustal core portion can be provided in a state that the whole surface thereof has been coated with the flow-able coating material.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE PREFERRED EMBODIMENTS

The crustal core samplers according to the present invention will hereinafter be described in detail. The crustal core samplers according to the present invention are particularly suitably used in, for example, the riser drilling method carried out in the above-described mode.

Figure 3:
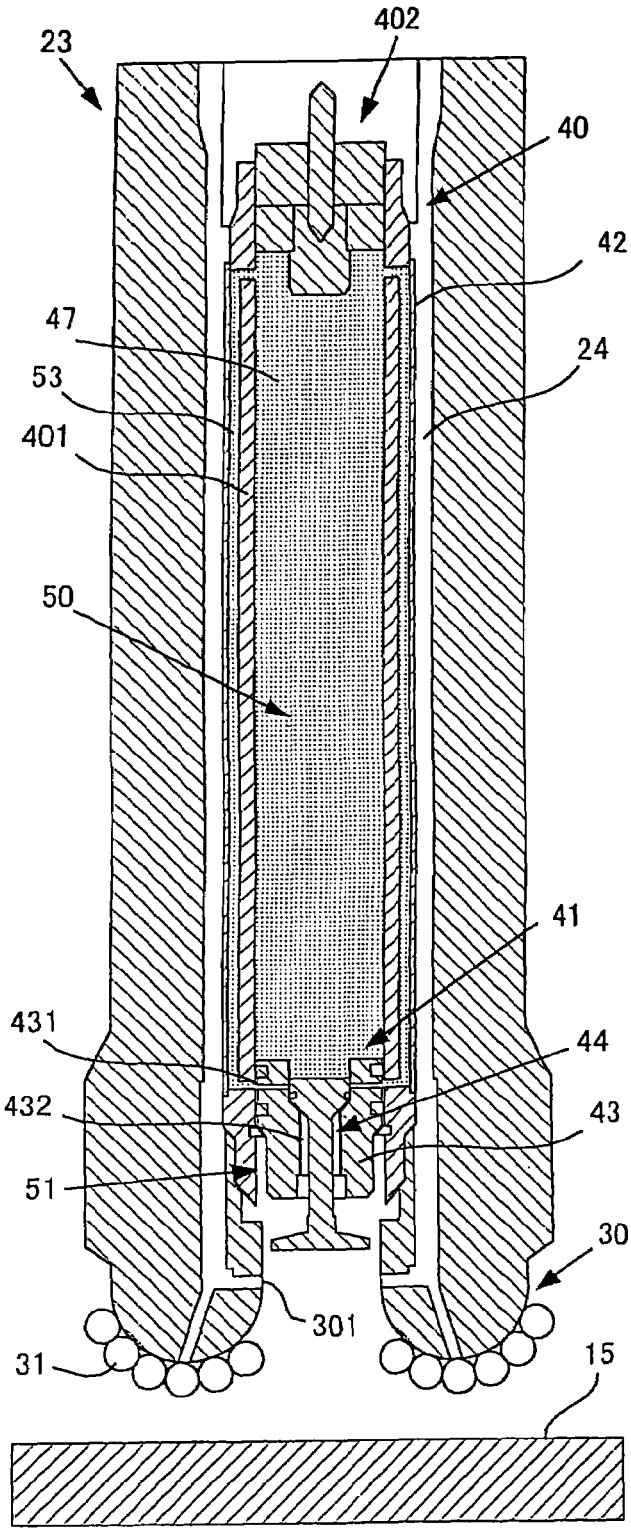
FIG. 3 is a sectional view illustrating a drill pipe and a drill bit right before submarine drilling is started, with a section taken along an axis of the pipe partly schematically shown.
Figure 4:
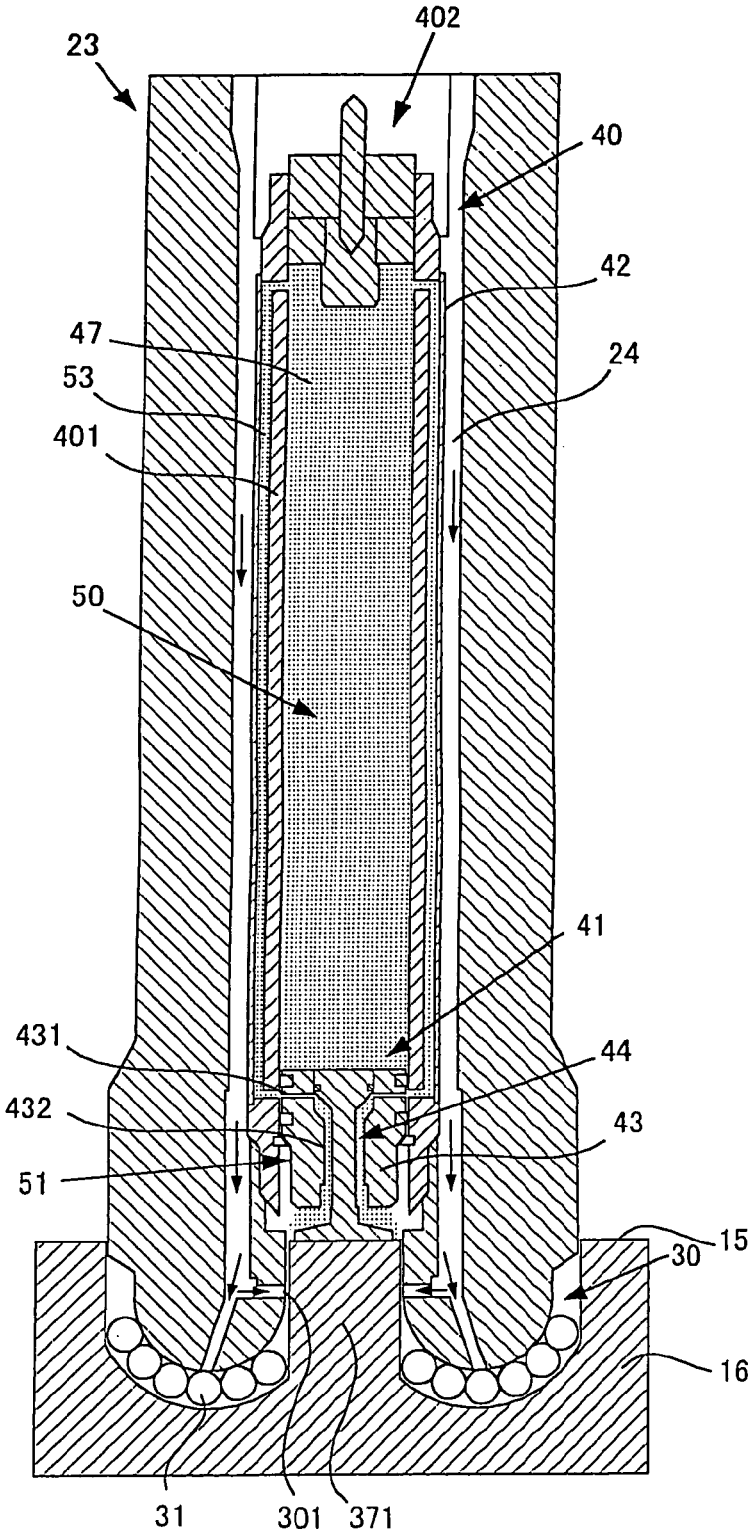
FIG. 4 is a sectional view illustrating the drill pipe and the drill bit right after the submarine drilling is started, with a section taken along the axis of the pipe partly schematically shown.
Figure 5:
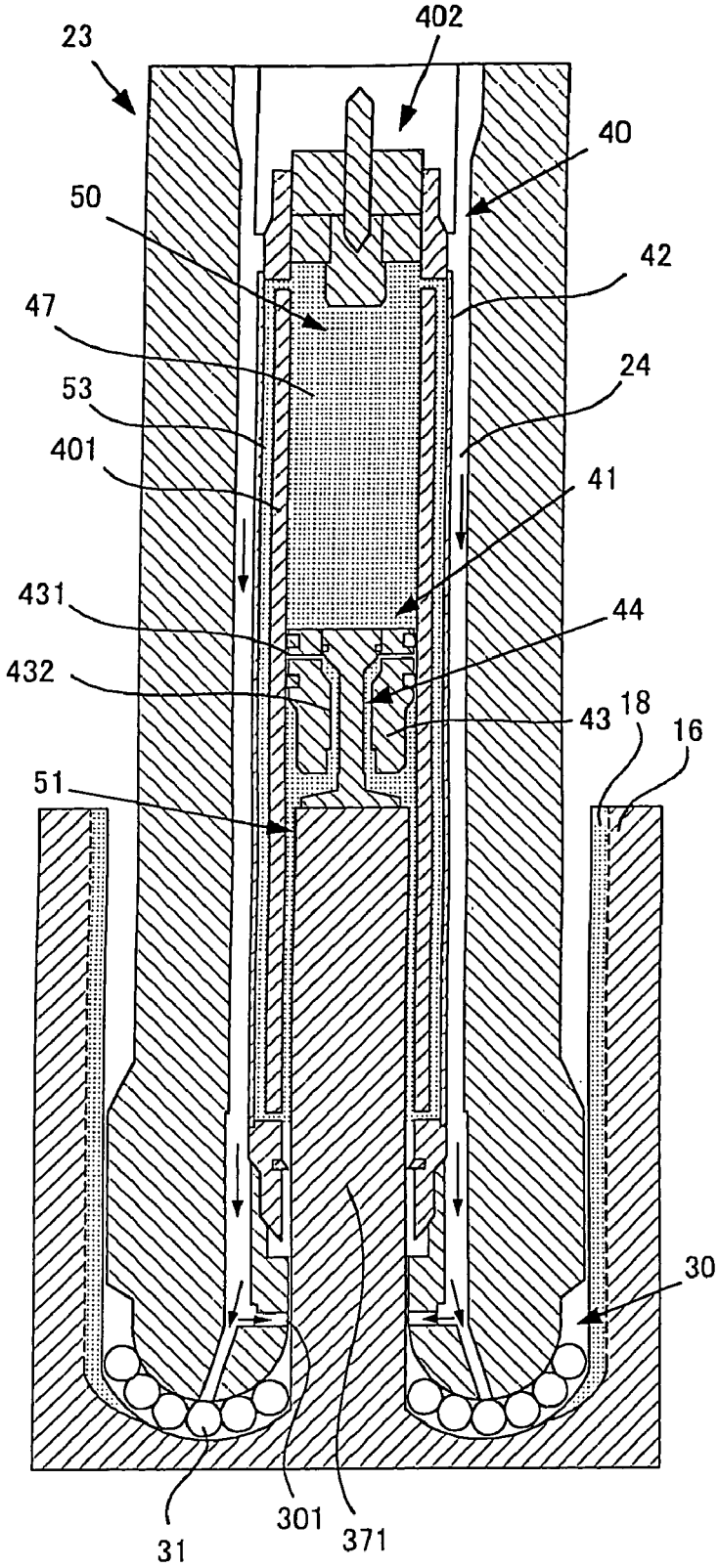
FIG. 5 is a sectional view illustrating the drill pipe and the drill bit during the submarine drilling, with a section taken along the axis of the pipe partly schematically shown.
Figure 6:
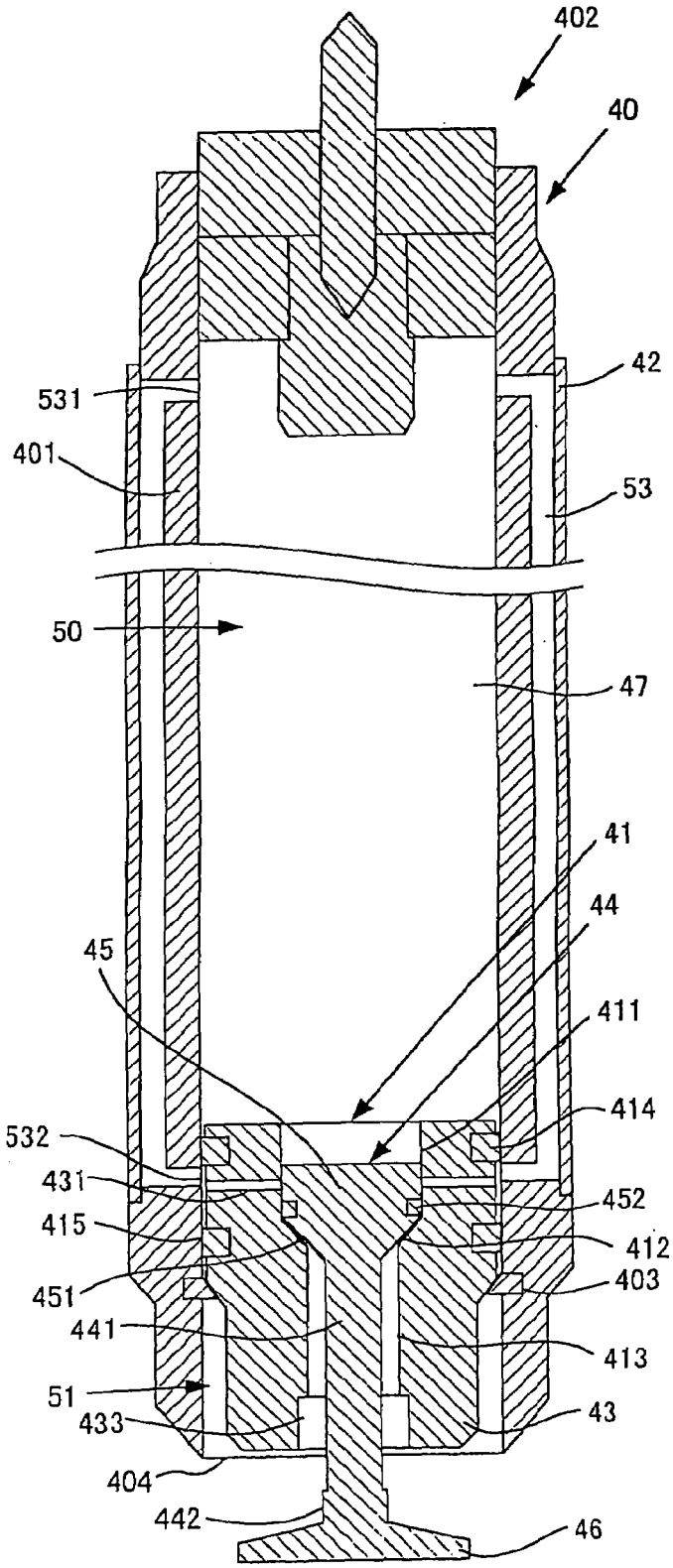
FIG. 6 is a sectional view illustrating, on an enlarged scale, the construction of a crustal core sampler according to the present invention.
Figure 7:
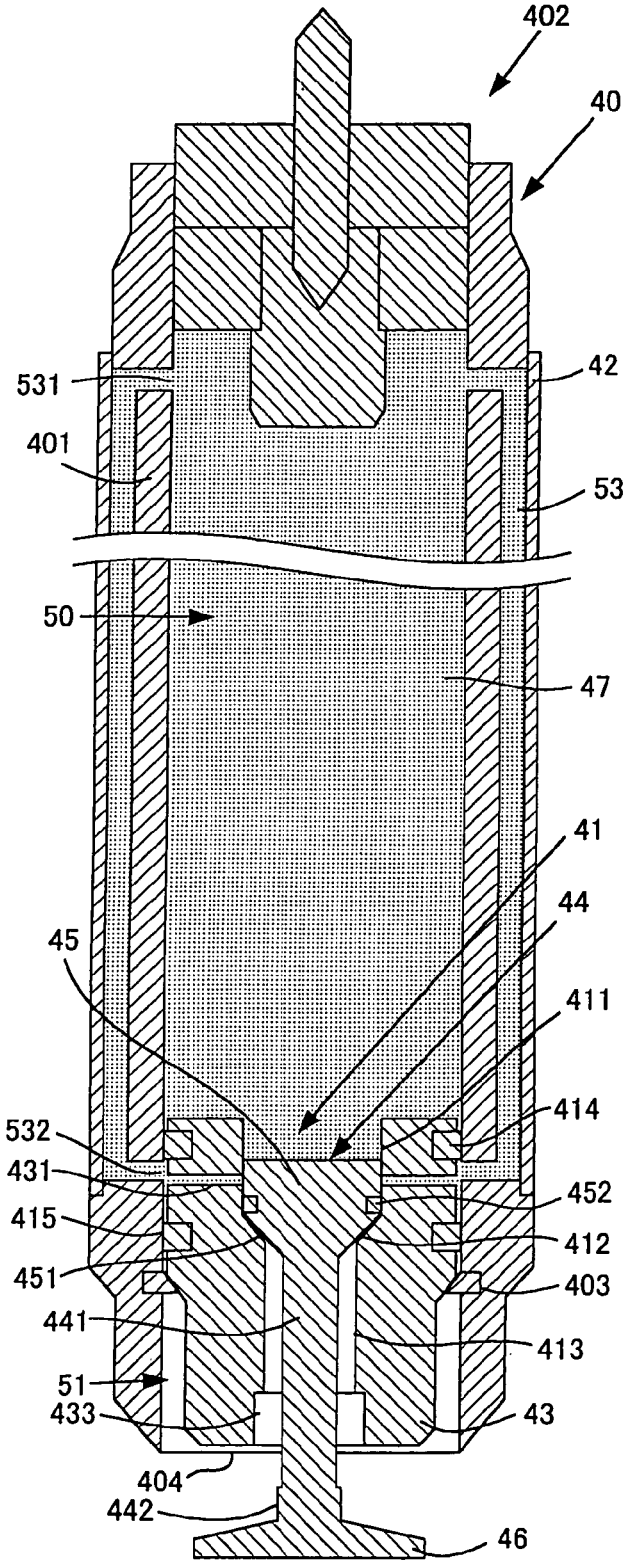
FIG. 7 is a sectional view illustrating, on an enlarged scale, the crustal core sampler in the operation state shown in FIG. 3.
Figure 8:
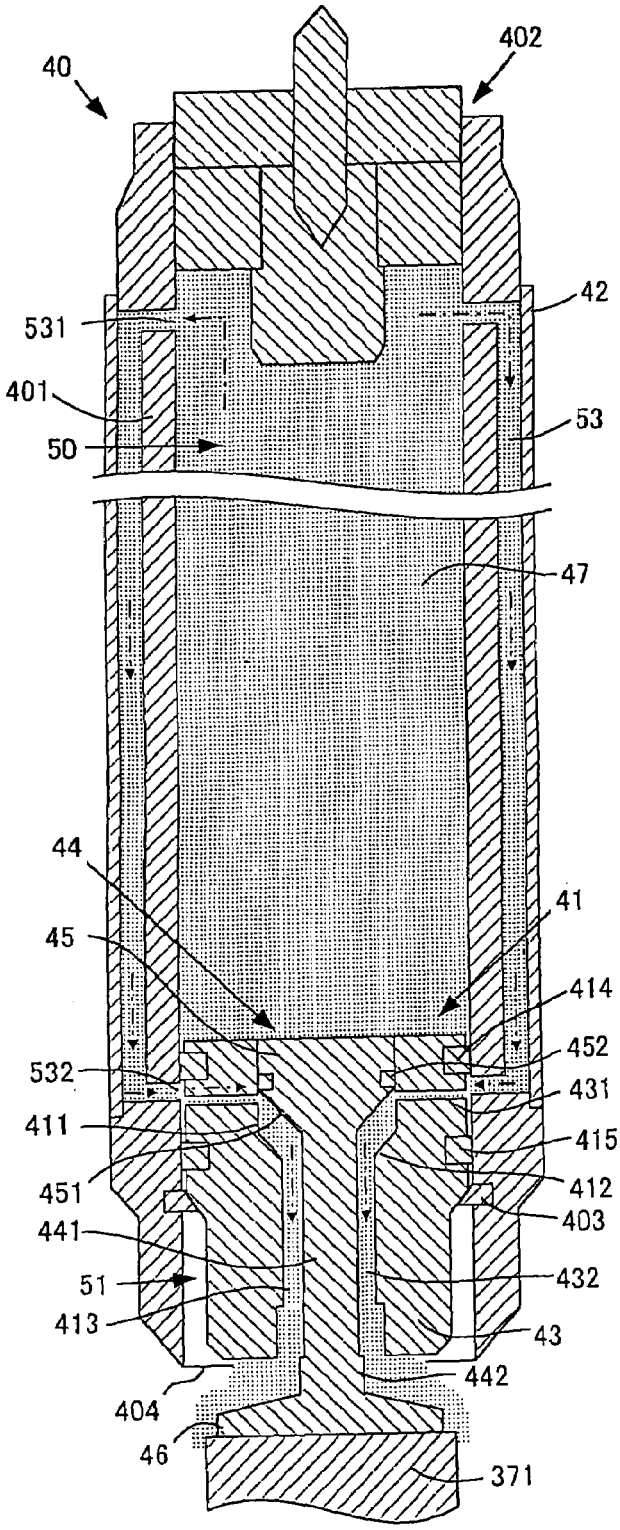
FIG. 8 is a sectional view illustrating, on an enlarged scale, the crustal core sampler in the operation state shown in FIG. 4.
Figure 9:
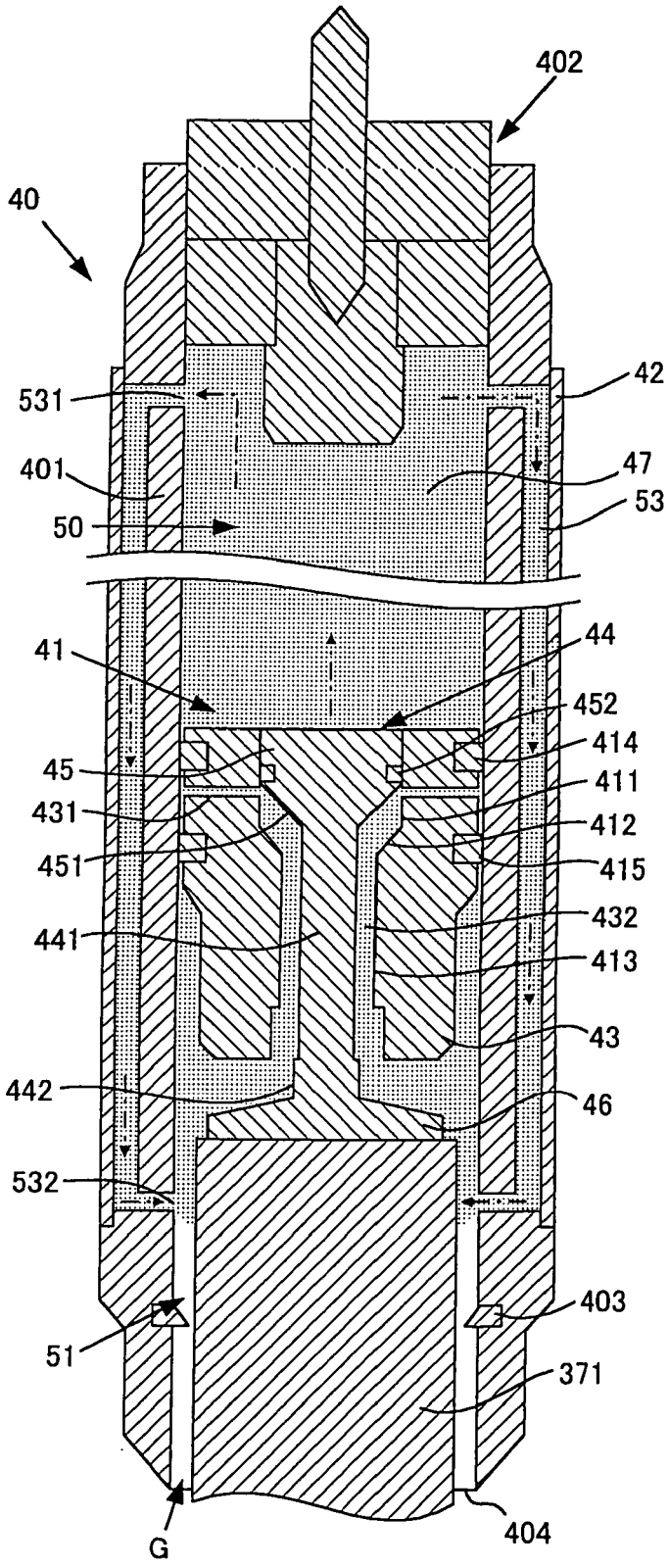
FIG. 9 is a sectional view illustrating, on an enlarged scale, the crustal core sampler in the operation state shown in FIG. 5.

FIGS. 3 to 5 are sectional views illustrating the states of an outer barrel, in which a crustal core sampler according to the present invention has been arranged, and a drill bit in drilling operation, with a section taken along the axis of the barrel. FIG. 3 illustrates a state right before drilling of the crust is started, FIG. 4 a state right after the drilling of the crust is started, and FIG. 5 a state that the drilling of the crust has been advanced to some extent. FIG. 6 is a sectional view illustrating, on an enlarged scale, the construction of the crustal core sampler. FIGS. 7 to 9 are sectional views illustrating, on an enlarged scale, the crustal core sampler in various operation states respectively shown in FIGS. 3 to 5.

Figure 1:
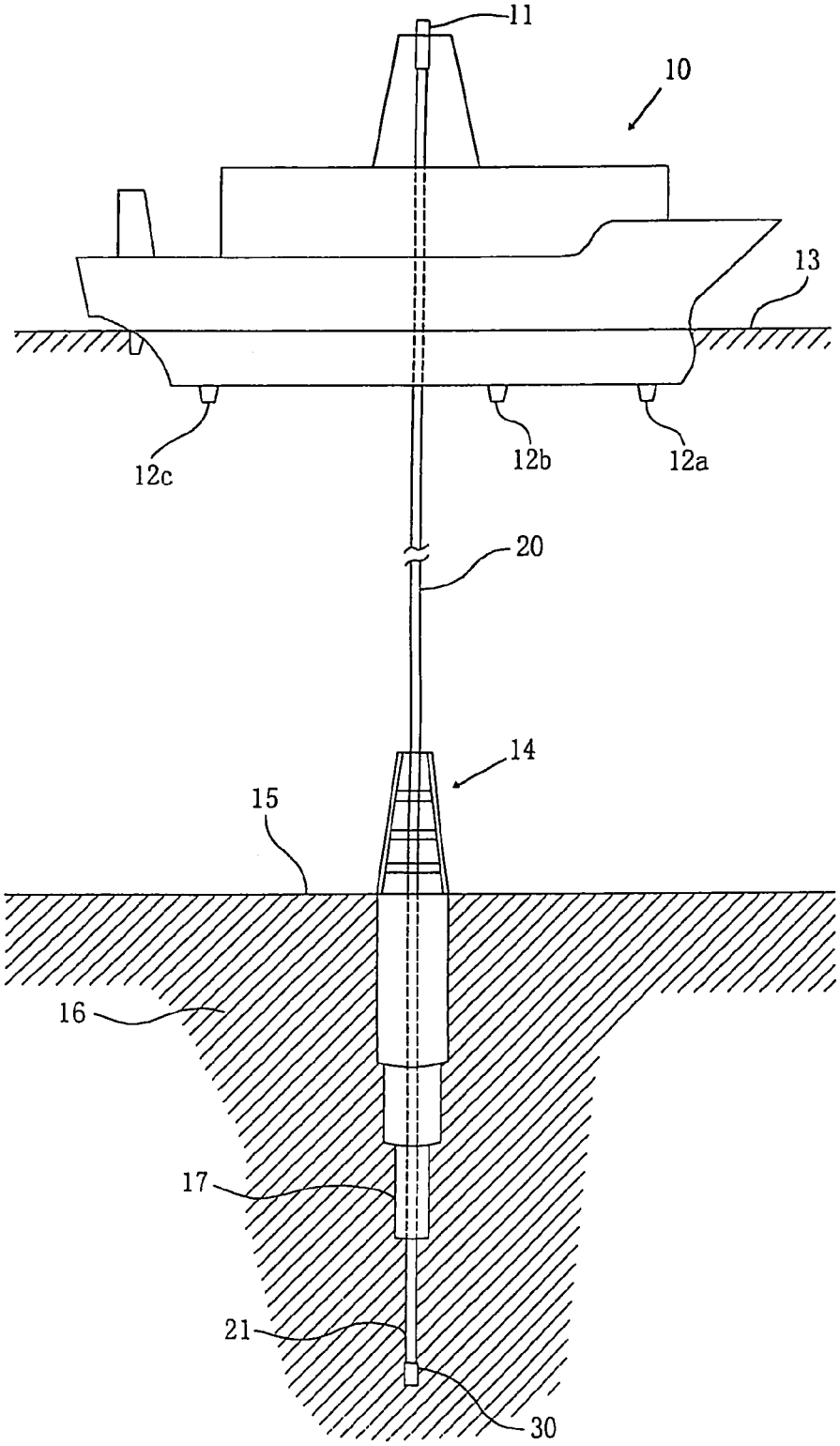
FIG. 1 illustrates a case where a submarine crust is drilled by means of a drill ship in accordance with the riser drilling method.
Figure 2:
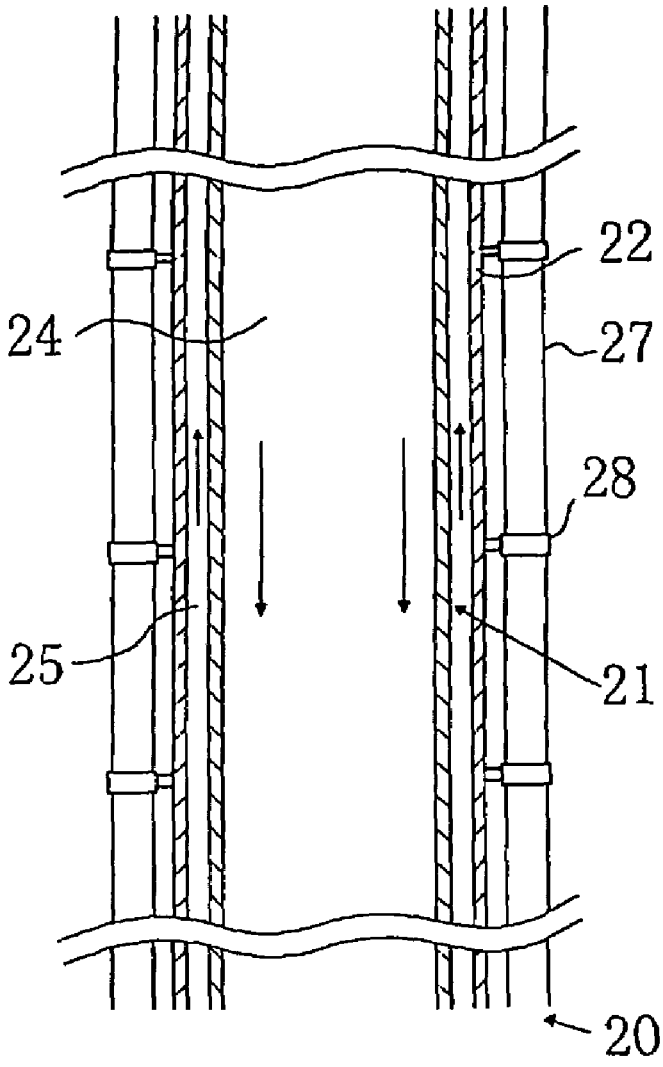
FIG. 2 is a partial sectional view illustrating details of compositional units making up a riser pipe together with a section of a main pipe, taken along its axis, in a state that a drill pipe has been inserted therein.

The crustal core sampler according to the present invention comprises a cylindrical outer barrel 23 making up a drill pipe 21 (see FIGS. 1 and 2) and equipped with a drill bit 30 at its lower end, and an inner barrel 40 arranged within the outer barrel 23. The drill bit 30 is provided with working fluid-ejecting openings 301 at its lower end.

The inner barrel 40 is equipped with a cylindrical inner barrel body, the upper end opening of which is closed with a closing member 402, and which has an opening 404 (see FIG. 6) for inserting a columnar crustal core portion at its lower end, a core elevator 41 arranged in an internal space of the inner barrel body 401 and movably in an axial direction thereof, a cylindrical channel-forming member 42 integrally provided with the inner barrel body 401 for forming a cylinderical flow-able coating material-running channel 53 with an outer peripheral surface of the inner barrel body 401, and flow-able coating material-ejecting openings 532 (see FIG. 6) for ejecting a flow-able coating material 47 inwardly in a radial direction of the inner barrel body 401 at a position in close vicinity of the opening 404 for inserting the columnar crustal core portion in the inner barrel body 401.

As illustrated in FIG. 3, the inner barrel 40 is arranged in such a manner that the opening 404 for inserting the columnar crustal core portion in the inner barrel body 401 is positioned above the working fluid-ejecting openings 301 of the drill bit 30.

In the inner barrel 40, a flow-able coating material-ejecting mechanism for ejecting the flow-able coating material is formed by the flow-able coating material-running channel 53 and the flow-able coating material-ejecting openings 532.

In FIGS. 6 and 7, the core elevator 41 is illustrated in a state positioned at the lowest position that movement to a position lower than this is restricted in the internal space of the inner barrel body 401 by being supported by a stopper 403 formed projectingly inwardly from an inner peripheral wall surface of the inner barrel body 401. In the state that the core elevator 41 has been positioned at the lowest position as described above, a region partitioned by 2 O-rings 414 and 415 in an outer peripheral surface of a core elevator body 43, which will be described subsequently, faces the flow-able coating material-ejecting openings 532 to achieve a state that linking holes 431 have been linked with the flow-able coating material-ejecting openings 532.

In this embodiment, the inner barrel 40 is so constructed that its inner diameter is somewhat greater than a diameter of the innermost peripheral surface of loci drawn by rotation of cutter elements 31 of the drill bit 30, i.e., an outer diameter of a columnar crustal core portion 371 formed by drilling as described below.

As illustrated in FIG. 6, the flow-able coating material-running channel 53 is linked with a plurality of inlet openings 531 radially extending so as to open into the internal space of the inner barrel body 401 at its upper end, and also linked with a plurality of the flow-able coating material-ejecting openings 532 radially extending so as to open into the internal space of the inner barrel body 401 at its lower end.

The core elevator 41 is composed of a cylindrical core elevator body 43 having a central through-hole and arranged in a state that its outer peripheral surface liquid-tightly and slidably comes into contact with an inner peripheral surface of the inner barrel body 401 over the whole periphery though the 2 O-rings 414 and 415 arranged in a state separated from each other in a vertical direction. In the core elevator body 43, the linking holes 431 for linking the space in the central through-hole with the flow-able coating material-ejecting openings 532 are formed in a region between the 2 O-rings 414 and 415, and an opening and closing valve body 44 for controlling a linked state between the space in the central through-hole and the linking holes 431 by moving in a vertical direction in the central through-hole is arranged.

Specifically, the central through-hole in the core elevator body 43 is defined by vertically linking an upper space part 411 opening into an upper side with a lower space part 413 having an inner diameter smaller than the upper space part 411 and opening into a lower side through a tapered part 412 whose inner diameter becomes smaller toward the lower side.

The linking holes 431 are so formed that their one ends open into an outer peripheral surface of the core elevator body 43 in a region partitioned by the upper O-ring 414 and the lower O-ring 415 and extend inwardly in a radial direction, and the other ends open into a lower portion of the upper space part 411 to form a valve opening.

On an inner peripheral surface of the lower space part 413 in the core elevator body 43, a plurality of projected contact parts 433 each projecting inwardly in a radial direction are provided in a state separated from each other in a peripheral direction so as to come into contact with a flange 442 of a rod part 441, which will be described subsequently, at its lower end position.

The opening and closing valve body 44 has a columnar valve body part 45 whose outer diameter conforms to an inner diameter of the upper space part 411 and whose thickness in a vertical direction is smaller than the height of the upper space part 411, a tapered connecting part 451 integrally formed with the valve body part 45 at a lower end of the valve body part, whose outer diameter becomes smaller toward the lower side, a columnar rod part 441 extending from a lower end of the connecting part 451 to a lower side and having an outer diameter smaller than an inner diameter of the lower space part 413, and a working disk 46 integrally formed with the rod part 441 at a lower end of the rod part and having an outer diameter greater than the outer diameter of the valve body part 45 and smaller than the inner diameter of the inner barrel body 401. The flange 442 projecting outward in the radial direction over the whole periphery is provided at a lower end portion of the rod part 441.

In the outer peripheral surface of the columnar valve body part 45, an O-ring 452 liquid-tightly sliding on the inner peripheral surface of the upper space part 411 is provided at its lower end.

When the opening and closing valve body 44 in the core elevator 41 is relatively moved upward as illustrated in FIG. 8, the connecting part 451 is separated upward from the tapered part 412, whereby a substantially cylindrical linking channel 432 opening into a lower side is formed between the core elevator body 43 and the opening and closing valve body 44.

In the inner barrel 40 having the above-described structure, a flow-able coating material reservoir 50 for holding the flow-able coating material 47 is partitioned above the core elevator 41 by the internal space of the inner barrel body 40. When the core elevator 41 is relatively lifted, however, the volume of the flow-able coating material reservoir 50 is gradually reduced, and at the same time a crustal core sample-receiving space 51 (see FIG. 9) for receiving a columnar crustal core portion 371 formed by drilling is gradually formed.

Such a crustal core sampler as described above can be specifically constructed and used as a part of, for example, a standard rotary core barrel (RCB), piston type core barrel (advanced piston corer APC), motor-driven core barrel (MDCB), pressure-retaining core barrel (PCS) or the like. These are used properly according the geological condition of the crust.

The crustal core sampler according to the present invention having such construction as described above is operated in the following manner.

As illustrated in FIGS. 3 and 7, the core elevator 41 is positioned at the lowest position restricted by the stopper 403 in a state right before drilling work is started, in which the drill bit 30 does not reach a sea floor 15, and the opening and closing valve body 44 thereof is positioned at a position where the connecting part 451 thereof is opposite to and comes into contact with the tapered part 412 of the core elevator body 43, i.e., at the lowest position to the core elevator body 43 by its own weight and the weight of the flow-able coating material 47 filled into the flow-able coating material reservoir 50.

In this state, the flow-able coating material-ejecting openings 532 are linked with the linking holes 431, but valve openings at the other ends of the linking holes 431 are closed by the valve body part 45, whereby the space within the central through-hole in the core elevator body 43 is shut off from the flow-able coating material-ejecting openings 532. Accordingly, the flow-able coating material 47 does not flow out in this state.

When the drilling of the crust 16 is then started as illustrated in FIGS. 4 and 8, the outer barrel 23 is rotated and goes down from the sea floor 15 while drilling so as to form an annular drilled groove. The opening and closing valve body 44 in the core elevator 41 is pushed up by contact of the working disk 46 with the sea floor 15 relatively upward to a position where the flange 442 comes into contact with the projected contact parts 433.

At this time, the core elevator body 43 of the core elevator 41 is not moved relatively to the inner barrel 40, but the connecting part 451 of the opening and closing valve body 44 is separated upward from the tapered part 412, and so the space within the central through-hole in the core elevator 41 is linked with the flow-able coating material-running channel 53 through the linking channel 432.

As a result, a state that the core elevator 41 is allowed to lift in the flow-able coating material reservoir 50 is achieved. The reason for it is that the flow-able coating material 47 in the flow-able coating material reservoir 50 can be caused to flow out through the flow-able coating material-running channel 53, linking holes 431 and linking channel 432.

On the other hand, the flow-able coating material 47 flown out from the central through-hole in the core elevator 41 comes to reach a peripheral region of the upper surface of the working disk 46 and the surface of a columnar core sample portion 371 formed halfway through the opening 404 for inserting the columnar crustal core portion as illustrated in FIG. 8.

In this state, a vertically movable distance of the opening and closing valve body 44 in the core elevator 41 is a separation distance between the flange 442 of the opening and closing valve body 44 and the projected contact parts 433 of the core elevator body 43 in the state that the opening and closing valve body 44 is positioned at the lowest position where the connecting part 451 of the opening and closing valve body 44 is opposite to and comes into contact with the tapered part 412 to be supported as illustrated in FIG. 6. However, this movable distance is controlled to a distance shorter than the height of the upper space part 411.

In a state that the opening and closing valve body 44 is positioned at the highest position as illustrated in FIG. 8 or 9, namely, a state that it is raised relatively to the core elevator body 43, and the flange 442 comes into contact with the projected contact parts 433, the O-ring 452 of the opening and closing valve body 44 does thereby not deviate from the upper space part 411 though positioned above the linking holes 431, so that a liquid-tight state between the core elevator body 43 and the flow-able coating material reservoir 50 is retained.

If the movable distance of the opening and closing valve body 44 is greater than the height of the upper space part 411, the connecting part 451 is exposed to the flow-able coating material reservoir 50 when the opening and closing valve body 44 is positioned at its highest position, so that the liquid-tightness in the core elevator 41 cannot be achieved.

When the drilling step is further progressed as illustrated in FIGS. 5 and 9, the outer barrel 23 and inner barrel 40 go down with the drilling, but the core elevator 41 is relatively lifted in the internal space of the inner barrel body 401 by the opening and closing valve body 44 positioned at the highest position and relatively pushed up by the surface of the columnar core sample portion 371. Thereby, in the internal space of the inner barrel body 401, are formed a flow-able coating material reservoir 50, whose lower end is gradually rising, over the lifting core elevator 41 and a crustal core sample-receiving space 51, whose upper end is gradually rising, under the core elevator 41. The columnar crustal core portion 371 formed by the drilling gradually enters the crustal core sample-receiving space 51 and is received therein.

On the other hand, when the core elevator 41 is lifted relatively to the inner barrel body 401, and the whole core elevator body 43 passes through a position where the flow-able coating material-ejecting openings 532 are formed and is positioned above the position, the flow-able coating material reservoir 50 is held in a state linked with the crustal core sample-receiving space 51 through the flow-able coating material-running channel 53 and flow-able coating material-ejecting openings 532.

Pressure is applied to the flow-able coating material 47 kept in the flow-able coating material reservoir 50 by lifting the core elevator 41. As a result, the flow-able coating material 47 is ejected inwardly in a radial direction of the crustal core sample-reserving space 51 with adequate power from the ejecting openings 532 through the flow-able coating material-running channel 53.

At this time, the outer peripheral surface of the columnar crustal core portion 371 formed by rotation of the cutter elements 31 of the drill bit 30 is in a state positioned slightly inside the inner periphery of the crustal core sample-receiving space 51, so that a narrow annular gap G is defined between the outer peripheral surface of the columnar crustal core portion 371 and the inner peripheral wall surface of the crustal core sample-receiving space 51. In other words, the columnar crustal core portion 371 is in a state received in the crustal core sample-receiving space 51 through the annular gap G.

When the columnar crustal core portion 371 gradually enters the crustal core sample-receiving space 51, the flow-able coating material 47 is forcedly ejected on the whole outer peripheral surface thereof when the core portion passes through the flow-able coating material-ejecting openings 532.

More specifically, the columnar crustal core portion 371 formed by drilling the surrounding thereof enters the crustal core sample-receiving space 51 through the central opening in the drill bit 30 and the opening 404 for inserting the columnar crustal core portion relatively to downward movement of the outer barrel 23 and inner barrel 40 with the progress of the drilling. At this time, the flow-able coating material 47 ejected inwardly in the radial direction from the flow-able coating material-ejecting openings 532 is sprayed on and caused to adhere to the outer peripheral surface of the columnar crustal core portion 371. As a result, the whole outer peripheral surface of the columnar crustal core portion 371 is coated with the flow-able coating material 47.

As described above, the columnar crustal core portion 371 entered into the crustal core sample-receiving space 51 in a state coated with the flow-able coating material 47 is cut out at a lower portion thereof and taken. This crustal core portion is recovered as a crustal core sample together with the inner barrel 40 on the drill ship 10 (see FIG. 1) through the interior of the drill pipe 21 (see FIGS. 1 and 2) by a wire or the like.

Figure 10:
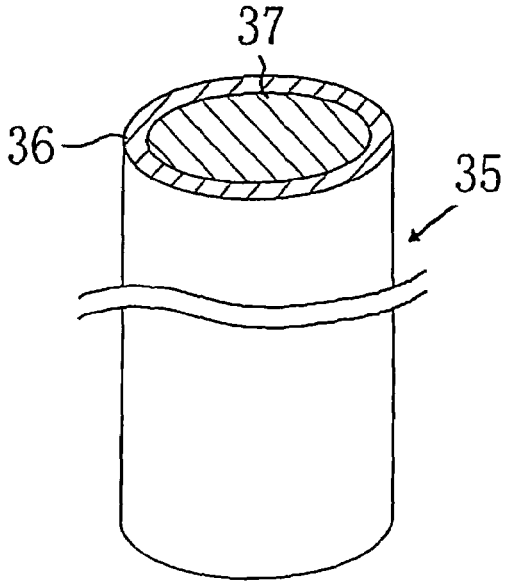
FIG. 10 is a sectional view illustrating a crustal core sample coated with a flow-able coating material, taken perpendicularly to the axis of a barrel.
Figure 11:
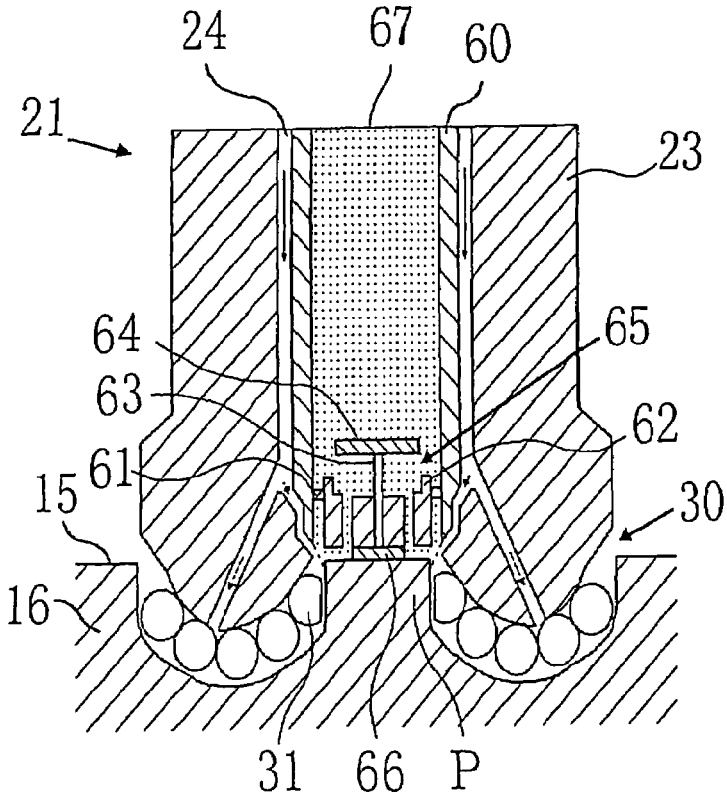
FIG. 11 is a sectional view illustrating a drill pipe and a drill bit in a conventional crustal core sampler right after submarine drilling is started, with a section taken along an axis of a pipe partly schematically shown.
Figure 12:
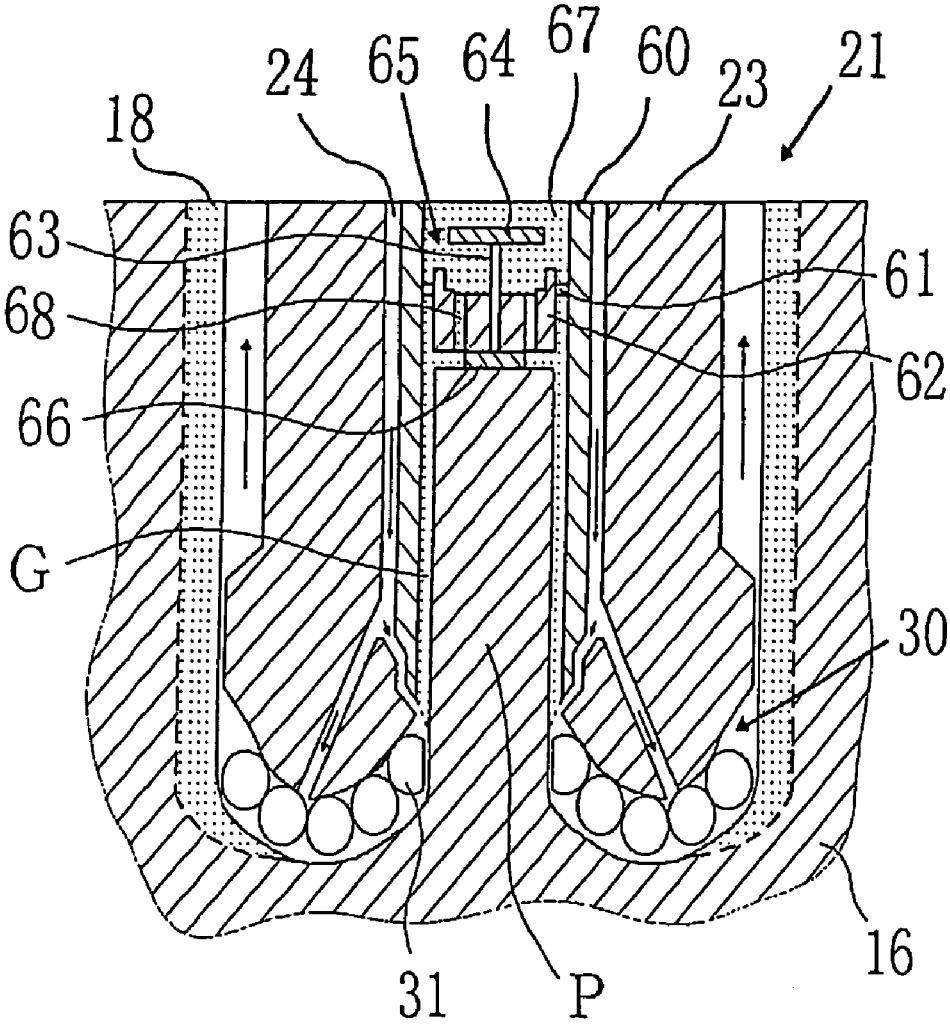
FIG. 12 is a sectional view illustrating the drill pipe and the drill bit in the conventional crustal core sampler during the submarine drilling, with a section taken along the axis of the pipe partly schematically shown.

Since the flow-able coating material 47 has fluidity, it comes around to an end surface formed at the time the columnar crustal core portion 371 has been cut out. As a result, the outer surface of the resulting crustal core sample 35 comes to be completely coated with the flow-able coating material 47. In such a manner, a crustal core sample 35 in a state that a flow-able coating material layer 36 has been formed on the outer surface of a crustal core 37 as illustrated in FIG. 10 is formed.

In the crustal core sampler according to the present invention, the amount of the flow-able coating material fed through the flow-able coating material-running channel 53 may be suitably selected according to various factors such as the kind or condition of geology in the crust to be drilled, research objects on the crustal core sample taken, physical properties of the flow-able coating material and drilling speed.

The feeding rate of the flow-able coating material is suitably selected in view of various constructional conditions on the crustal core sampler, for example, an area of a section perpendicular to the running direction of the flow-able coating material in the flow-able coating material-running channel 53, an inner diameter of the flow-able coating material reservoir, the total opening area of the inlet openings 531 or ejecting openings 532, and the like, and various operational conditions of the crustal core sampler, for example, physical properties of the flow-able coating material, drilling speed and the like.

The amount of the flow-able coating material ejected is set within a proper range, whereby the crustal core sample can be obtained in a state that its surface has been surely coated with the flow-able coating material.

The ejection speed of the flow-able coating material ejected from the flow-able coating material-running channel to the crustal core sample-receiving space may be suitably selected according to various factors such as the kind or condition of geology in the crust to be drilled, research objects on the crustal core sample taken, physical properties of the working fluid and drilling speed. This ejection speed of the flow-able coating material can be achieved by suitably setting the total opening area and opening form of the ejecting openings 532 and the number of the ejecting openings 532, etc. according to the feeding rate of the flow-able coating material.

The flow-able coating material is ejected from the flow-able coating material-ejecting openings 532 at a proper speed, whereby contaminants adhered to the outer peripheral surface of the columnar crustal core portion 371 can be washed off with high efficiency.

A crustal core sampler according to another embodiment of the present invention will now be described.

Figure 13:
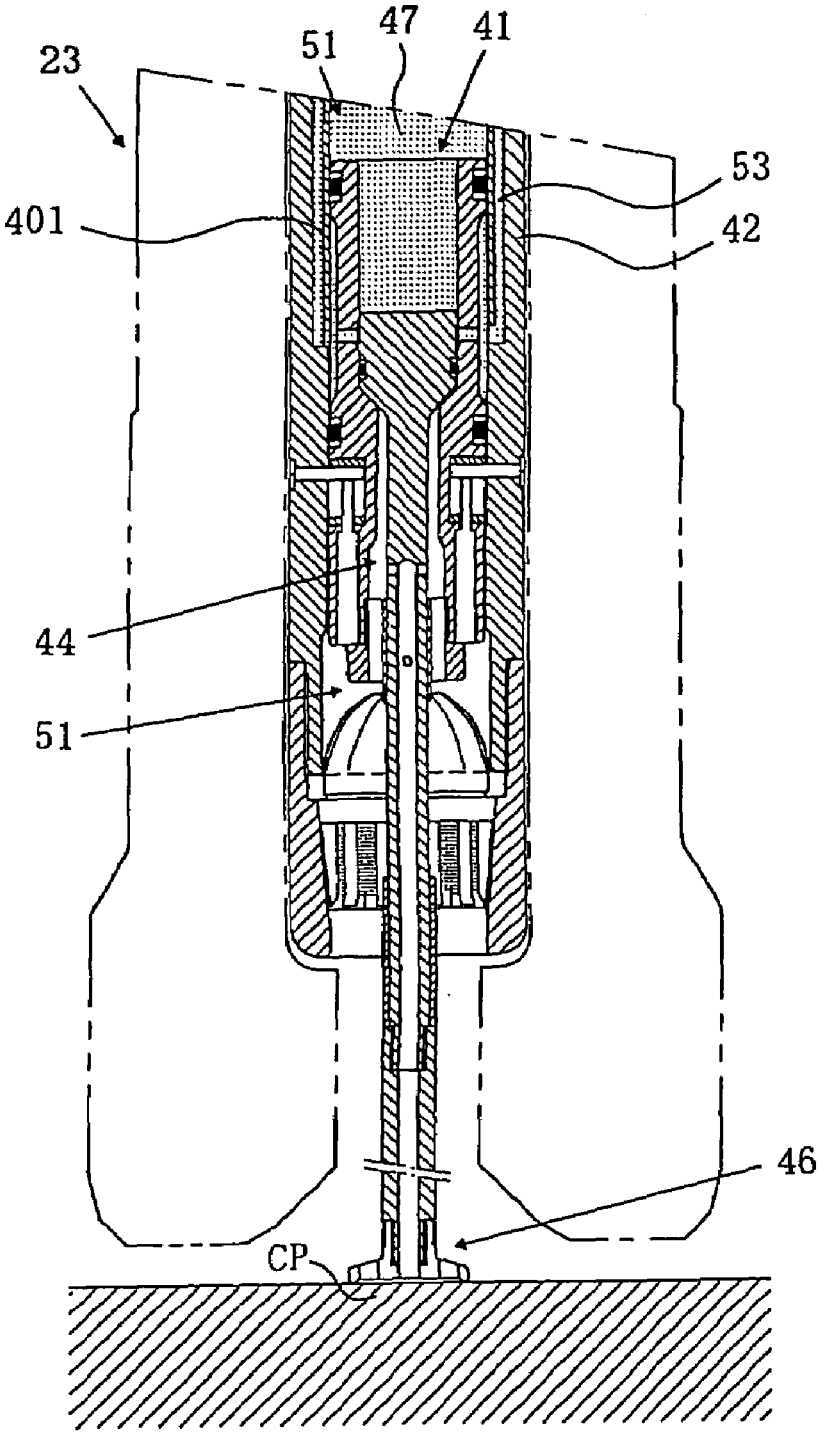
FIG. 13 is a sectional view illustrating the construction of anther exemplary crustal core sampler according to the present invention, with a section taken along an axis of a barrel with its part omitted, and showing a state right before drilling of the crust is started.

FIG. 13 is a sectional view illustrating the construction of anther exemplary crustal core sampler according to the present invention, with a section taken along the axis of a barrel with its part omitted, and showing a state right before drilling of the crust is started.

Figure 14:
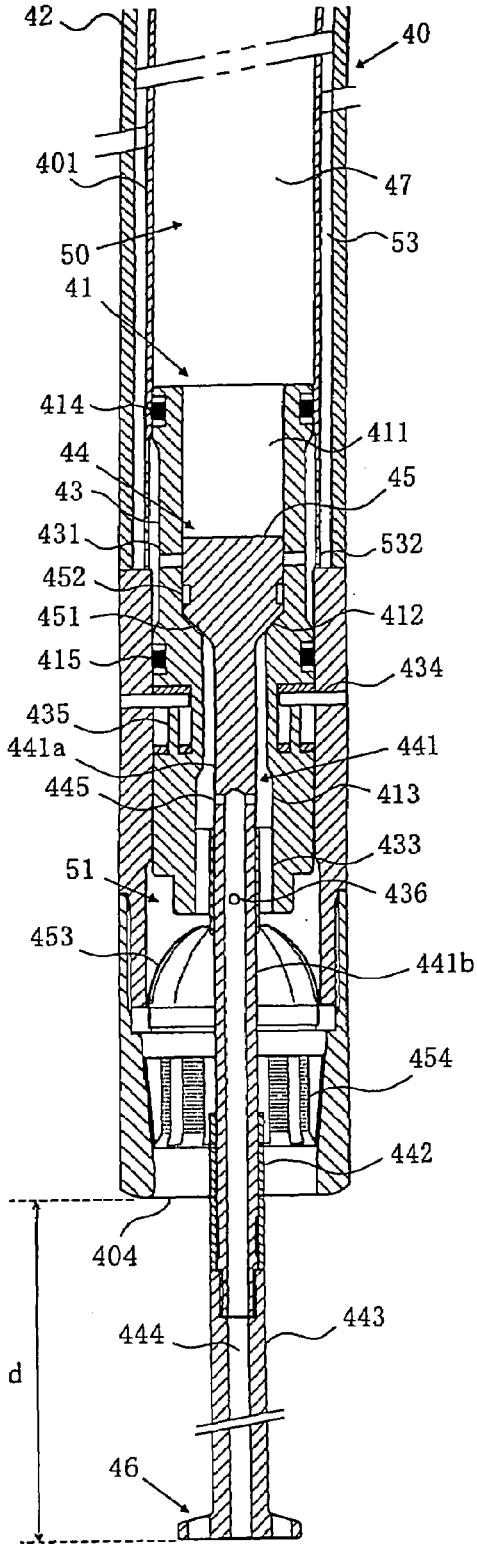
FIG. 14 is a sectional view illustrating, on an enlarged scale, the construction of an inner barrel in FIG. 13.
Figure 15:
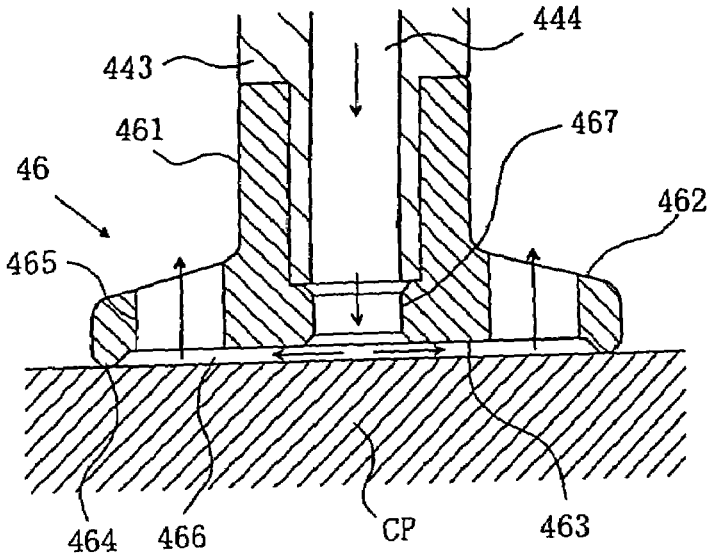
FIG. 15 is a sectional view illustrating, on an enlarged scale, the construction of a working disk taken along an axis of a rod part.
Figure 16:
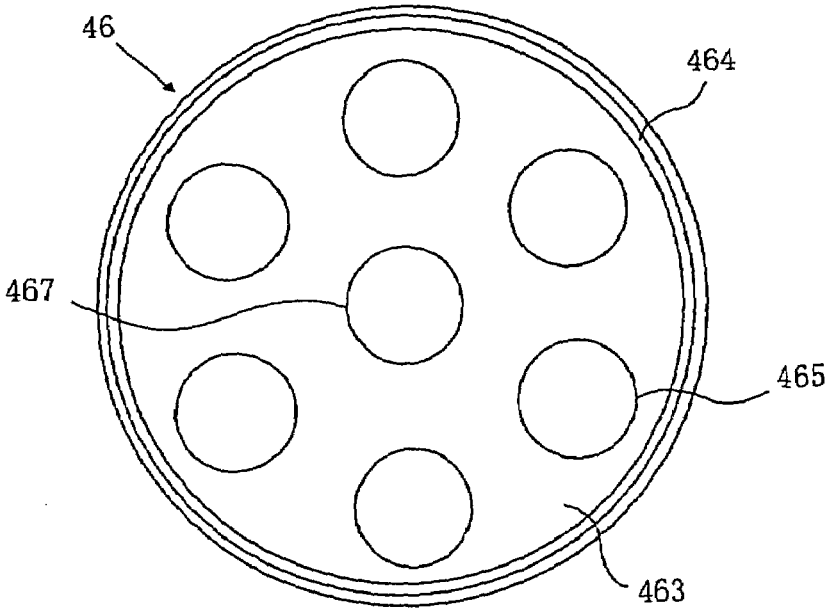
FIG. 16 is a plan view illustrating, on an enlarged scale, a bottom surface of the working disk.

FIG. 14 is a sectional view illustrating, on an enlarged scale, the construction of an inner barrel in the embodiment shown in FIG. 13, taken along an axis of a barrel, FIG. 15 is a sectional view illustrating, on an enlarged scale, the construction of a working disk taken along an axis of a rod part, and FIG. 16 is a plan view illustrating, on an enlarged scale, a bottom surface of the working disk.

The crustal core sampler shown in FIG. 13 basically has the same construction as the above-described crustal core sampler except for the following respects.

In other words, in the crustal core sampler of this embodiment, a rod part 441 making up a core elevator 41 is formed by a columnar base part 441*a*, a cylindrical tip part 441*b* and a cylindrical rod member 443 for extension. A flow-able coating material-guiding channel 444 for running the flow-able coat material 47 downward is formed by the internal spaces of the cylindrical tip part 441*b* and cylindrical rod member 443 for extension.

Specifically, the cylindrical tip part 441*b* further extends continuously downward from a lower end of the base part 441*a* positioned within the central through-hole of the core elevator body 43, and the cylindrical rod member 443 for extension is connected to a lower end of the cylindrical tip part 441*b*, thereby forming a rod part 441. A working disk 46, which will be described subsequently, is provided on a lower end of this rod part 441. At least one linking channel 445 for linking the flow-able coating material-guiding channel 444 with a lower space 413 is formed in an upper region of the cylindrical tip part 441*b* passing through the wall of the tip part in a radial direction thereof.

No particular limitation is imposed on the inner diameter and length of the rod part 441. However, the inner diameter is, for example, 5 to 10 mm, particularly 8 mm, and the overall length may be such length that a projected length d that the opening and closing valve body 44 projects from the opening 404 for inserting the columnar crustal core portion in a state that the opening and closing valve body 44 has been positioned at the lowest position amounts to, for example, 60 to 100 mm. The rod part is so constructed that its length can be changed by selecting and using a cylindrical rod member 443 for extension having a proper length.

The working disk 46 shown in FIG. 15 is in the form of a substantially flat plate having a diameter greater than the outer diameter of the rod part 441 and smaller than the outer diameter of the columnar crustal core portion formed by the drilling and has a cylindrical connecting part 461 rising upward at a central portion of its upper surface 462. The working disk is connected and fixed to the lower end of the cylindrical rod member 443 for extension at this cylindrical connecting part 461.

In a bottom surface 463 of the working disk 46, a through-hole 467 opening into its central portion is linked with the flow-able coating material-guiding channel 444, and a ring-like contact member 464 projecting downward so as to extend along its peripheral edge portion of the bottom surface is formed. A plurality of open holes 465 (6 holes in the embodiment illustrated in FIG. 16) extending so as to pass through the working disk 46 in a thickness-wise direction thereof are formed around the through-hole 467 so as to surround the opening thereof in a circumferential direction. In other words, the flow-able coating material-guiding channel 444 is opened at its lower end into an upper surface of a portion CP of the crust through the through-hole 467. In this embodiment, no particular limitation is imposed on the size and shape of the open holes 465. However, they may be formed into a columnar form having a diameter of, for example, 8 mm.

No particular limitation is imposed on the shape and height of the contact member 464 so far as it is formed so as to project downward from the bottom surface 463 to come into contact with the crust portion CP. Specifically, the contact member 464 may be formed by, for example, a plurality of projected members, not the ring-like member. The height of the contact member 464 may be suitably determined according to the thickness of a coating film to be formed on the upper surface of the crust portion PC with the flow-able coating material 47, and is set to, for example, 0.5 to 5 mm, particularly 1.5 mm.

In FIG. 14, reference numeral 434 is a shear pin for temporarily fixing the core elevator body 43 to the inner barrel body 401, which breaks when stress greater than a prescribed value is applied through a shear plunger 435. Reference numeral 436 is a shear pin for temporarily fixing the opening and closing valve body 44 to the core elevator body 43, which breaks when stress greater than a prescribed value is applied to the opening and closing valve body 44. Reference numerals 453 and 454 are a basket lifter and a core lifter, respectively.

According to the crustal core sampler of such construction as described above, the contact member 464 of the working disk 46 comes into contact with the crust portion CP to form a gap between the upper surface of the crust portion CP and the bottom surface 463 of the working disk 46, and a flow-able coating material-retaining space 466 linked with the through-hole 467 is defined by this gap.

When the shear pin 436 is broken upon drilling of the crust portion PC, and the opening and closing valve body 44 is pushed up, a temporarily linked state between the flow-able coating material-ejecting openings 532 and the space within the central through-hole is created by the already described mode. In synchronism with this, a temporarily linked state between the flow-able coating material-guiding channel 444 and the flow-able coating material-ejecting openings 532 through the linking channel 445 is also achieved.

When pressure is applied to the flow-able coating material 47 held in the flow-able coating material reservoir 50 by raising the opening and closing valve body 44, and consequently the flow-able coating material is fed into the central through-hole through the linking holes 431. The flow-able coating material flows down through the central through-hole and is filled into the crustal core sample-receiving space 51 equipped with the basket lifter 453 as a catch pan. When the crustal core sample-receiving space 51 is filled with the flow-able coating material, the whole or most of the flow-able coating material fed thereafter flows into the flow-able coating material-guiding channel 444 through the linking channel 445. The flow-able coating material flown into the flow-able coating material-guiding channel 444 further flows downward and is ejected from the through-hole 467. As a result, the flow-able coating material is filled into the flow-able coating material-retaining space 466, and an excess of the flow-able coating material overflows on an upper surface 462 of the working disk 46 and surroundings thereof through the open holes 465. A state that the upper surface of the crust portion CP has been coated with the flow-able coating material is surely realized.

In the method of coring a crustal core sample using such a crustal core sampler as described above, various materials may be used as the flow-able coating material 47 so far as they have fluidity. However, they may preferably retain various properties of the crustal core sample taken in a state having been present in the crust or a state right after drilled, and a proper material may be selected according to the kind of the intended research using the crustal core sample taken, the condition of geology of the crust to be drilled, or the like.

Specifically, for example, polymeric gel that is a jam-like high-viscosity fluid may be preferably used as the flow-able coating material 47. For example, that having antimicrobial activity or that having curability that cures after the crustal core sample is coated may be suitably used.

According to the crustal core sampler of the present invention, the flow-able coating material-running channel is provided in a mode independent of the inner space of the inner barrel body, and the flow-able coating material held in the flow-able coating material reservoir is directly fed to the columnar crustal core portion, so that the flow-able coating material is not mixed and diluted with, for example, a working fluid and is always applied to the columnar crust core portion in a state that the expected physical properties have been surely retained. Accordingly, the proper properties of the flow-able coating material are surely retained, and a crustal core sample suitable for various intended researches or the like can be obtained with certainty.

The flow-able coating material is ejected from the ejecting openings at a proper speed, whereby the flow-able coating material is forcedly sprayed on the outer peripheral surface of the columnar crustal core portion entering the crustal core sample-receiving space, so that the working fluid as a source of contaminants or a contaminant, which has unavoidably adhered to the outer peripheral surface of the columnar crustal core portion upon drilling can be scraped out of the outer peripheral surface. As a result, a crustal core sample free of any contamination with adventitious nonindigeneous substances or substantially free of such contamination can be cored.

The flow-able coating material-guiding channel is provided by the cylindrical rod part, whereby a crustal core sample can be obtained in a state that the whole peripheral surface of the sample, including its upper surface, has been surely coated with the flow-able coating material. Accordingly, the expected effects by the flow-able coating material can be achieved with certainty.

In the above-described crustal core sampler according to the present invention, the inner barrel is arranged to a prescribed position within the outer barrel by throwing it from a drill ship and causing it to freely fall within the drill pipe to drill a columnar crustal core sample. At this time, the arrangement of the shear pin prevents the core elevator and/or the opening and closing valve body from unexpectedly moving upward to wash away a great amount of the flow-able coating material even when the inner barrel is deployed into water, and great impact force is applied upward to the core elevator and/or the opening and closing valve body.

According to the method of coring a crustal core sample of the present invention, the crustal core sample is coated with the flow-able coating material in a mode that a contaminant derived from, for example, a working fluid has been removed from the outer surface thereof, so that the condition in the crust of the crustal core sample or the condition right after drilled can be surely retained. Accordingly, the crustal core sample can be cored in a mode suitable for various researches.

The drilling method in the case where the crustal core sampler according to the present invention is used is not limited to specific methods, and this method can be practiced to publicly known various drilling methods. In particular, the method can be easily practiced in the drilling of the submarine crust making good use of a drill ship such as the above-described riser drilling method.

Although the crustal core samplers and method of coring a crustal core sample according to the present invention have been described specifically above, various modifications may be added to the present invention.

For example, the flow-able coating material is not required to be ejected perpendicularly to an axial direction, and it may be ejected in a direction inclined downward.

What is claimed is:

1. A crustal core sampler for coring crustal core sample by drilling crust using a fluid for drilling work, said crustal core sampler comprising:

a cylindrical drill pipe comprising at a lower end thereof a drill bit having at least one ejection opening for electing the fluid for drilling work; and an inner barrel arranged in the drill pipe;

wherein the inner barrel comprises:

a cylindrical inner barrel body, which has an opening for inserting a columnar crustal core portion at a lower end thereof and which receives a columnar crustal core portion formed by drilling as a crustal core sample in an interior thereof;

a core elevator arranged in an internal space of the inner barrel body so as to be movable in an axial direction thereof; and a flow-able coating material-ejecting mechanism including a channel-forming member for forming a flow-able coating material-running channel with an outer peripheral surface of the inner barrel body, and flow-able coating material-ejecting openings for ejecting a flow-able coating material from the flow-able coating a material-running channel inwardly in a radial direction of the inner barrel body at a position in close vicinity of the lower end of the inner barrel body;

wherein the inner barrel is arranged such that the opening for inserting the columnar crustal core portion is positioned above the ejection opening of the drill bit for the fluid for drilling work;

wherein the columnar crustal core portion formed by the drilling is coated with the flowable coating material ejected from the flow-able coating material-ejecting openings while being positioned in the interior of the inner barrel body while being relatively raised in the internal space of the inner barrel body;

wherein the core elevator comprises:

a core elevator body having a central through-hole; and an opening and closing valve body, arranged in the central through-hole of the core elevator body, for controlling a linked state between a space in the central through-hole and the flow-able coating material-ejecting openings by moving in a vertical direction; and wherein a temporary linked state is achieved between the space in the central through-hole of the core elevator body and the flowable coating material-ejecting openings at a beginning of upward movement of the core elevator body within the inner barrel body.

2. The crustal core sampler according to claim 1, wherein a flow-able coating material reservoir for holding the flow-able coating material is defined by a space partitioned above the core elevator to be lifted, a crustal core sample-receiving space for receiving the crustal core sample is defined by a space partitioned below the core elevator, and the flow-able coating material reservoir is linked with the crustal core sample-receiving space by the flowable coating material-running channel.

3. The crustal core sampler according to claim 1, wherein the running channel-forming member comprises a cylindrical member, such that the flow-able coating material-running channel formed with the outer peripheral surface of the inner barrel body is cylindrical.

4. The crustal core sampler according to claim 3, wherein the opening and closing valve body comprises a columnar valve body part and a tubular rod part which extends so as to protrude downward from the core elevator body through the central through-hole thereof and which has an opening at a lower end thereof, and wherein a temporary linked state is achieved between the flow-able coating material-ejecting openings and the opening at the lower end of the rod part via the space within the central through-hole in the core elevator body at the beginning of upward movement of the core elevator body within the inner barrel body.

5. The crustal core sampler according to claim 4, wherein a working disk having a diameter greater than an outer diameter of the rod part is arranged at the lower end of the rod part, and a contact member protruding downward from a bottom surface of the working disk is provided on the bottom surface of the working disk.

6. The crustal core sampler according to claim 1, wherein the opening and closing valve body comprises a columnar valve body part and a tubular rod part which extends so as to protrude downward from the core elevator body through the central through-hole thereof and which has an opening at a lower end thereof, and wherein a temporary linked state is achieved between the flow-able coating material-ejecting openings and the opening at the lower end of the rod part via the space within the central through-hole in the core elevator body at the beginning of upward movement of the core elevator body within the inner barrel body.

7. The crustal core sampler according to claim 6, wherein a working disk having a diameter greater than an outer diameter of the rod part is arranged at the lower end of the rod part, and a contact member protruding downward from a bottom surface of the working disk is provided on the bottom surface of the working disk.

8. A method comprising using a crustal core sampler for coring a crustal core sample by drilling crust using a fluid for drilling work, so as to core the crustal core sample in a state coated with a flow-able coating material;

wherein the crustal core sampler comprises:

a cylindrical drill pipe comprising at a lower end thereof a drill bit having at least one ejection opening for ejecting the fluid for drilling work; and an inner barrel arranged in the drill pipe;

wherein the inner barrel comprises:

a cylindrical inner barrel body, which has an opening for inserting a columnar crustal core portion at a lower end thereof and which receives a columnar crustal core portion formed by drilling as a crustal core sample in an interior thereof;

a core elevator arranged in an internal space of the inner barrel body so as to be movable in an axial direction thereof; and a flow-able coating material-ejecting mechanism including a channel-forming member for forming a flow-able coating material-running channel with an outer peripheral surface of the inner barrel body, and flow-able coating material-ejecting openings for ejecting a flow-able coating material from the flow-able coating material-running channel inwardly in a radial direction of the inner barrel body at a position in close vicinity of the lower end of the inner barrel body;

wherein the inner barrel is arranged such that the opening for inserting the columnar crustal core portion is positioned above the ejection opening of the drill bit for the fluid for drilling work;

wherein the columnar crustal core portion formed by the drilling is coated with the flow-able coating material ejected from the flow-able coating material-ejecting openings while being positioned in the interior of the inner barrel body while being relatively raised in the internal space of the inner barrel body;

wherein the core elevator comprises:

a core elevator body having a central through-hole; and an opening and closing valve body, arranged in the central through hole of the core elevator body, for controlling a linked state between a space in the central through-hole and the flow-able coating material-ejecting openings by moving in a vertical direction; and wherein a temporary linked state is achieved between the space in the central through-hole of the core elevator body and the flow-able coating material-ejecting openings at a beginning of upward movement of the core elevator body within the inner barrel body.

9. A method comprising using a crustal core sampler for coring a crustal core sample by drilling crust using a fluid for drilling work, so as to core the crustal core sample in a state coated with a flow-able coating material;

wherein the crustal core sampler comprises:

a cylindrical drill pipe comprising at a lower end thereof a drill bit having at least one ejection opening for ejecting the fluid for drilling work; and an inner barrel arranged in the drill pipe;

wherein the inner barrel comprises:

a cylindrical inner barrel body, which has an opening for inserting a columnar crustal core portion at a lower end thereof and which receives a columnar crustal core portion formed by drilling as a crustal core sample in an interior thereof;

a core elevator arranged in an internal space of the inner barrel body so as to be movable in an axial direction thereof; and a flow-able coating material-ejecting mechanism including a channel-forming member for forming a flow-able coating material-running channel with an outer peripheral surface of the inner barrel body, and flow-able coating material-ejecting openings for electing a flow-able coating material from the flow-able coating material-running channel inwardly in a radial direction of the inner barrel body at a position in close vicinity of the lower end of the inner barrel body;

wherein the inner barrel is arranged such that the opening for inserting the columnar crustal core portion is positioned above the ejection opening of the drill bit for the fluid for drilling work;

wherein the columnar crustal core portion formed by the drilling is coated with the flow-able coating material ejected from the flow-able coating material-ejecting openings while being positioned in the interior of the inner barrel body while being relatively raised in the internal space of the inner barrel body;

wherein the running channel-forming member comprises a cylindrical member, such that the flow-able coating material-running channel formed with the outer peripheral surface of the inner barrel body is cylindrical;

wherein the core elevator comprises:

a core elevator body having a central through hole; and an opening and closing valve body, arranged in the central through-hole of the core elevator body, for controlling a linked state between a space in the central through-hole and the flow-able coating material-ejecting openings by moving in a vertical direction; and wherein a temporary linked state is achieved between the space in the central through-hole of the core elevator body and the flow-able coating material-ejecting openings at a beginning of upward movement of the core elevator body within the inner barrel body.

10. A method comprising using a crustal core sampler for coring a crustal core sample by drilling crust using a fluid for drilling work, so as to core the crustal core sample in a state coated with a flow-able coating material;

wherein the crustal core sampler comprises:

a cylindrical drill pipe comprising at a lower end thereof a drill bit having at least one ejection opening for ejecting the fluid for drilling work; and an inner barrel arranged in the drill pipe;

wherein the inner barrel comprises:

a cylindrical inner barrel body, which has an opening for inserting a columnar crustal core portion at a lower end thereof and which receives a columnar crustal core portion formed by drilling as a crustal core sample in an internal thereof;

a core elevator arranged in an internal space of the inner barrel body so as to be movable in an axial direction thereof; and a flow-able coating material-ejecting mechanism including a channel-forming member for forming a flow-able coating material-running channel with an outer peripheral surface of the inner barrel body, and flow-able coating material-ejecting openings for ejecting a flow-able coating material from the flow-able coating material-running channel inwardly in a radial direction of the inner barrel body at a position in close vicinity of the lower end of the inner barrel body;

wherein the inner barrel is arranged such that the opening for inserting the columnar crustal core portion is positioned above the ejection opening of the drill bit for the fluid for drilling work;

wherein the columnar crustal core portion formed by the drilling is coated with the flow-able coating material ejected from the flow-able coating material-ejecting openings while being positioned in the interior of the inner barrel body while being relatively raised in the internal solace of the inner barrel body;

wherein the core elevator comprises:

a core elevator body having a central through-hole; and an opening and closing valve body, arranged in the central through-hole of the core elevator body, for controlling a linked state between a space in the central through-hole and the flow-able coating material-ejecting openings by moving in a vertical direction;

wherein a temporary linked state is achieved between the space in the central through-hole of the core elevator body and the flow-able coating material-ejecting openings at a beginning of upward movement of the core elevator body within the inner barrel body;

wherein the opening and closing valve body comprises a columnar valve body part and a tubular rod part which extends so as to protrude downward from the core elevator body through the central through-hole thereof and which has an opening at a lower end thereof; and wherein a temporary linked state is achieved between the flow-able coating material-ejecting openings and the opening at the lower end of the rod part via the space within the central through-hole in the core elevator body at the beginning of upward movement of the core elevator body within the inner barrel body.

11. A method comprising using a crustal core sampler for coring a crustal core sample by drilling crust using a fluid for drilling work, so as to core the crustal core sample in a state coated with a flow-able coating material;

wherein the crustal core sampler comprises:

a cylindrical drill pipe comprising at a lower end thereof a drill bit having at least one ejection opening for ejecting the fluid for drilling work; and an inner barrel arranged in the drill pipe;

wherein the inner barrel comprises:

a cylindrical inner barrel body, which has an opening for inserting a columnar crustal core portion at a lower end thereof and which receives a columnar crustal core portion formed by drilling as a crustal core sample in an interior thereof;

a core elevator arranged in an internal space of the inner barrel body so as to be movable in an axial direction thereof; and a flowable coating material-ejecting mechanism including a channel-forming member for forming a flow-able coating material-running channel with an outer peripheral surface of the inner barrel body, and flow-able coating material-ejecting openings for ejecting a flow-able coating material from the flow-able coating material-running channel inwardly in a radial direction at the inner barrel body at a position in close vicinity of the lower end of the inner barrel body;

wherein the inner barrel is arranged such that the opening for inserting the columnar crustal core portion is positioned above the ejection opening of the drill bit for the fluid for drilling work;

wherein the columnar crustal core portion formed by the drilling is coated with the flow-able coating material ejected from the flow-able coating material-ejecting openings while being positioned in the interior of the inner barrel body while being relatively raised in the internal space of the inner barrel body;

wherein the running channel-forming member comprises a cylindrical member, such that the flow-able coating material-running channel formed with the outer peripheral surface of the inner barrel body is cylindrical;

wherein the core elevator comprises:

a core elevator body having a central through-hole; and an opening and closing valve body, arranged in the central through-hole of the core elevator body, for controlling a linked state between a space in the central through-hole and the flow-able coating material-ejecting openings by moving in a vertical direction;

wherein a temporary linked state is achieved between the space in the central through-hole of the core elevator body and the flow-able coating material-ejecting openings at a beginning of upward movement of the core elevator body within the inner barrel body;

wherein the opening and closing valve body comprises a columnar valve body part and a tubular rod part which extends so as to protrude downward from the core elevator body through the central through-hole thereof and which has an opening at a lower end thereof; and wherein a temporary linked state is achieved between the flow-able coating material-ejecting openings and the opening at the lower end of the rod part via the space within the central movement of the core elevator body within the inner barrel body.

12. A method comprising using a crustal core sampler for coring a crustal core sample by drilling crust using a fluid for drilling work, so as to core the crustal core sample in a state coated with a flow-able coating material;

wherein the crustal core sampler comprises:

a cylindrical drill pipe comprising at a lower end thereof a drill bit having at least one ejection opening for ejecting the fluid for drilling work; and an inner barrel arranged in the drill pipe;

wherein the inner barrel comprises:

a cylindrical inner barrel body, which has an opening for inserting a columnar crustal core portion at a lower end thereof and which receives a columnar crustal core portion formed by drilling as a crustal core sample in an interior thereof;

a core elevator arranged in an internal space of the inner barrel body so as to be movable in an axial direction thereof; and a flow-able coating material-ejecting mechanism including a channel-forming member for forming a flow-able coating material-running channel with an outer peripheral surface of the inner barrel body, and flow-able coating material-ejecting openings for ejecting a flow-able coating material from the flow-able coating material-running channel inwardly in a radial direction of the inner barrel body at a position in close vicinity of the lower end of the inner barrel body;

wherein the inner barrel is arranged such that the opening for inserting the columnar core portion is positioned above the ejection opening of the drill bit for the fluid for drilling work;

wherein the columnar crustal core portion formed by the drilling is coated with the flow-able coating material ejected from the flow-able coating material-ejecting openings while being positioned in the interior of the inner barrel body while being relatively raised in the internal space of the inner barrel body;

wherein the core elevator comprises:

a core elevator body having a central through-hole; and an opening and closing valve body, arranged in the central through-hole of the core elevator body, for controlling a linked state between a space in the central through-hole and the flow-able coating material-ejecting openings by moving in a vertical direction;

wherein a temporary linked state is achieved between the space in the central through-hole of the core elevator body and the flow-able coating material-ejecting openings at a beginning of upward movement of the core elevator body within the inner barrel body;

wherein the opening and closing valve body comprises a columnar valve body part and a tubular rod part which extends so as to protrude downward from the core elevator body through the central through-hole thereof and which has an opening at a lower end thereof;

wherein a temporary linked state is achieved between the flow-able coating material-ejecting openings and the opening at the lower end of the rod part via the space within the central through-hole in the core elevator body at the beginning of upward movement of the core elevator body within the inner barrel body; and wherein a working disk having a diameter greater than an outer diameter of the rod part is arranged at the lower end of the rod part, and a contact member protruding downward from a bottom surface of the working disk is provided on the bottom surface of the working disk.

13. A method comprising using a crustal core sampler for coring a crustal core sample by drilling crust using a fluid for drilling work, so as to core the crustal core sample in a state coated with a flow-able coating material;

wherein the crustal core sampler comprises:

a cylindrical drill pipe comprising at a lower end thereof a drill bit having at least one ejection opening for ejecting the fluid for drilling work; and an inner barrel arranged in the drill pipe;

wherein the inner barrel comprises:

a cylindrical inner barrel body, which has an opening for inserting a columnar crustal core portion at a lower end thereof and which receives a columnar crustal core portion formed by drilling as a crustal core sample in an interior thereof;

a core elevator arranged in an internal space of the inner barrel body so as to be movable in an axial direction thereof; and a flow-able coating material-ejecting mechanism including a channel-forming member for forming a flow-able coating material-running channel with an outer peripheral surface of the inner barrel body, and flow-able coating material-ejecting openings for ejecting a flow-able coating material from the flow-able coating material-running channel inwardly in a radial direction of the inner barrel body at a position in close vicinity of the lower end of the inner barrel body;

wherein the inner barrel is arranged such that the opening for inserting the columnar crustal core portion is positioned above the ejection opening of the drill bit for the fluid for drilling work;

wherein the columnar crustal core portion formed by the drilling is coated with the flow-able coating material ejected from the flow-able coating material-ejecting openings while being positioned in the interior of the inner barrel body while being relatively raised in the internal space of the inner barrel body;

wherein the running channel-forming member comprises a cylindrical member, such that the flow-able coating material-running channel formed with the outer peripheral surface of the inner barrel body is cylindrical;

wherein the core elevator comprises:

a core elevator body having a central through-hole; and an opening and closing valve body, arranged in the central through-hole of the core elevator body, for controlling a linked state between a space in the central through-hole and the flow-able coating material-ejecting openings by moving in a vertical direction;

wherein a temporary linked state is achieved between the space in the central through-hole of the core elevator body and the flow-able coating material-ejecting openings at a beginning of upward movement of the core elevator body within the inner barrel body;

wherein the opening and closing valve body comprises a columnar valve body part and a tubular rod part which extends so as to protrude downward from the core elevator body through the central through-hole thereof and which has an opening at a lower end thereof;

wherein a temporary linked state is achieved between the flow-able coating material-ejecting openings and the opening at the lower end of the rod part via the space within the central through-hole in the core elevator body at the beginning of upward movement of the core elevator body within the inner barrel body; and wherein a working disk having a diameter greater than an outer diameter of the rod part is arranged at the lower end of the rod part, and a contact member protruding downward from a bottom surface of the working disk is provided on the bottom surface of the working disk.

* * * * *